US009687956B2

(12) United States Patent
Tsai et al.

(10) Patent No.: US 9,687,956 B2
(45) Date of Patent: Jun. 27, 2017

(54) POLISHING PAD WITH OFFSET CONCENTRIC GROOVING PATTERN AND METHOD FOR POLISHING A SUBSTRATE THEREWITH

(71) Applicant: Cabot Microelectronics Corporation, Aurora, IL (US)

(72) Inventors: Ching-Ming Tsai, Aurora, IL (US); Shi-Wei Cheng, Aurora, IL (US); Kun-Shu Yang, Aurora, IL (US); Jia-Cheng Hsu, Aurora, IL (US); Sheng-Huan Liu, Aurora, IL (US); Feng-Chih Hsu, Aurora, IL (US); Craig Kokjohn, Aurora, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 14/440,209

(22) PCT Filed: Nov. 5, 2013

(86) PCT No.: PCT/US2013/068523
§ 371 (c)(1),
(2) Date: May 1, 2015

(87) PCT Pub. No.: WO2014/074521
PCT Pub. Date: May 15, 2014

(65) Prior Publication Data

US 2015/0298287 A1 Oct. 22, 2015

Related U.S. Application Data

(60) Provisional application No. 61/723,226, filed on Nov. 6, 2012.

(51) Int. Cl.
*B24B 37/16* (2012.01)
*B24B 37/26* (2012.01)
*B24B 37/04* (2012.01)

(52) U.S. Cl.
CPC ..... *B24B 37/26* (2013.01); *B24B 37/042* (2013.01); *B24B 37/16* (2013.01)

(58) Field of Classification Search
CPC ..... B24B 37/042; B24B 37/16; B24B 37/26
(Continued)

(56) References Cited

U.S. PATENT DOCUMENTS 5,842,910 A * 12/1998 Krywanczyk ..... B24B 37/26 451/285
6,736,709 B1 5/2004 James et al.
(Continued)

FOREIGN PATENT DOCUMENTS

KR 10-2001-0002471 A 1/2001
KR 10-2001-0035983 A 5/2001

OTHER PUBLICATIONS

Korean Intellectual Property Office, International Search Report in International Patent Application No. PCT/US2013/068523 (Feb. 26, 2014).
(Continued)

*Primary Examiner* — Eileen Morgan
(74) *Attorney, Agent, or Firm* — Thomas Omholt; Erika Wilson

(57) ABSTRACT

The invention provides a polishing pad and a method of using the polishing pad for chemically-mechanically polishing a substrate. The polishing pad comprises a plurality of grooves composed of at least a first plurality of concentric grooves having a first center of concentricity, and a second plurality of concentric grooves having a second center of concentricity. The first center of concentricity is not coin-
(Continued)

cident with the second center of concentricity, the axis of rotation of the polishing pad is not coincident with at least one of the first center of concentricity and the second center of concentricity, the plurality of grooves does not consist of a continuous spiral groove, and the polishing surface does not comprise a mosaic groove pattern.

19 Claims, 5 Drawing Sheets

(58) Field of Classification Search
USPC ..... 451/41, 527
See application file for complete search history.

(56) References Cited

U.S. PATENT DOCUMENTS

| | | | | |
|---|---|---|---|---|
| 6,896,593 | B2 | 5/2005 | Prasad | |
| 7,234,224 | B1 | 6/2007 | Naugler et al. | |
| 7,252,582 | B2 * | 8/2007 | Renteln | B24B 37/26 451/527 |
| 7,377,840 | B2 * | 5/2008 | Deopura | B24B 37/26 451/527 |
| 7,614,933 | B2 | 11/2009 | Benvegnu et al. | |
| 8,932,116 | B2 * | 1/2015 | Deopura | B24B 37/26 451/527 |
| 9,180,570 | B2 * | 11/2015 | Kerprich | B24B 37/26 |
| 2006/0046626 | A1 * | 3/2006 | Renteln | B24B 37/26 451/527 |
| 2008/0211141 | A1 * | 9/2008 | Deopura | B24B 37/26 264/331.19 |
| 2010/0009601 | A1 | 1/2010 | Wang | |

OTHER PUBLICATIONS

Taiwan Intellectual Property Office, Office Action issued for Taiwan Patent Application No. 102140320 on Mar. 1, 2016.

* cited by examiner

FIG. 1
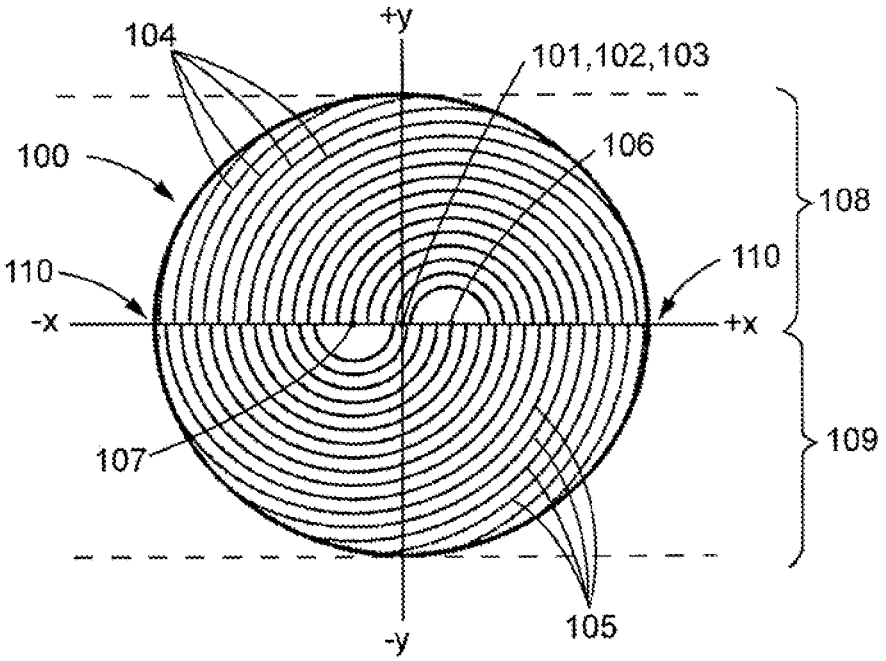
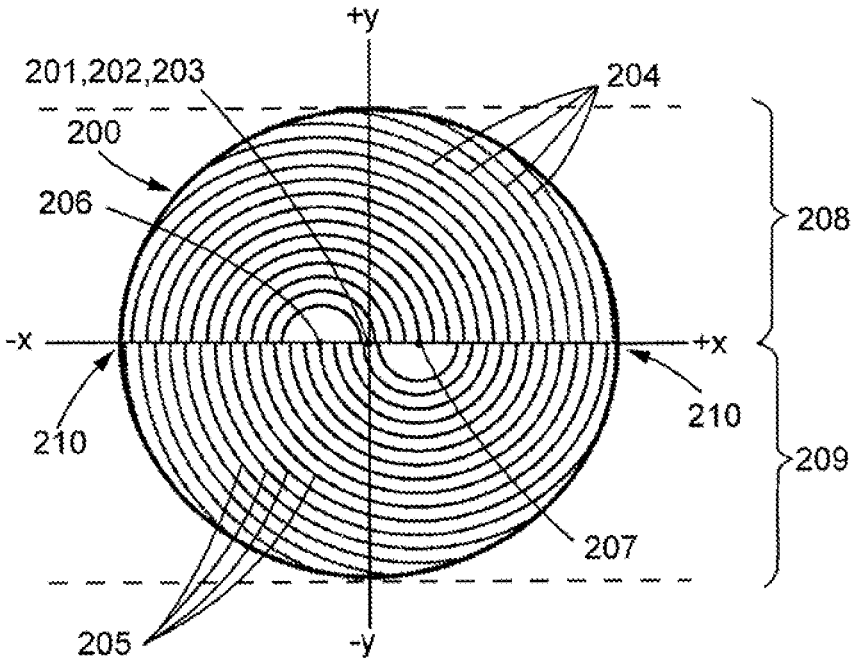
FIG. 2

FIG. 3
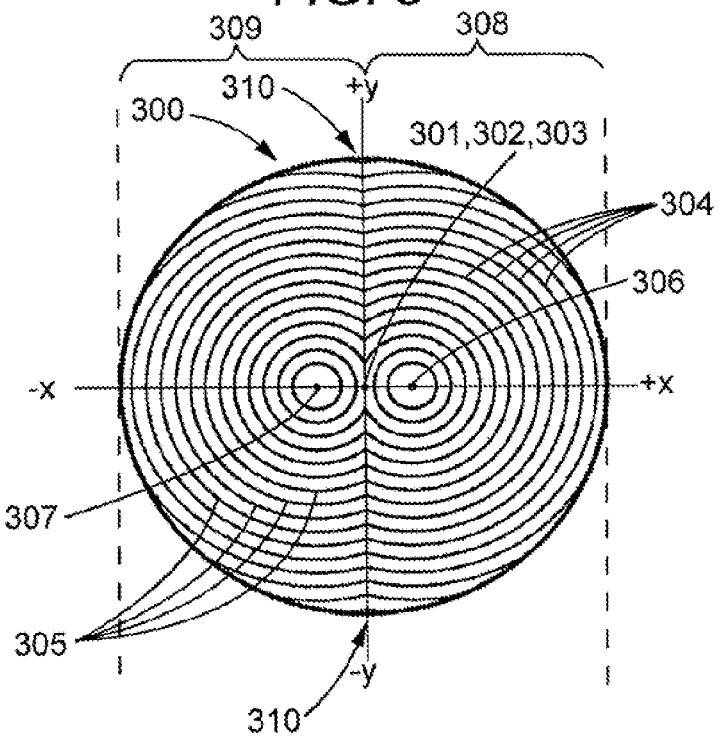
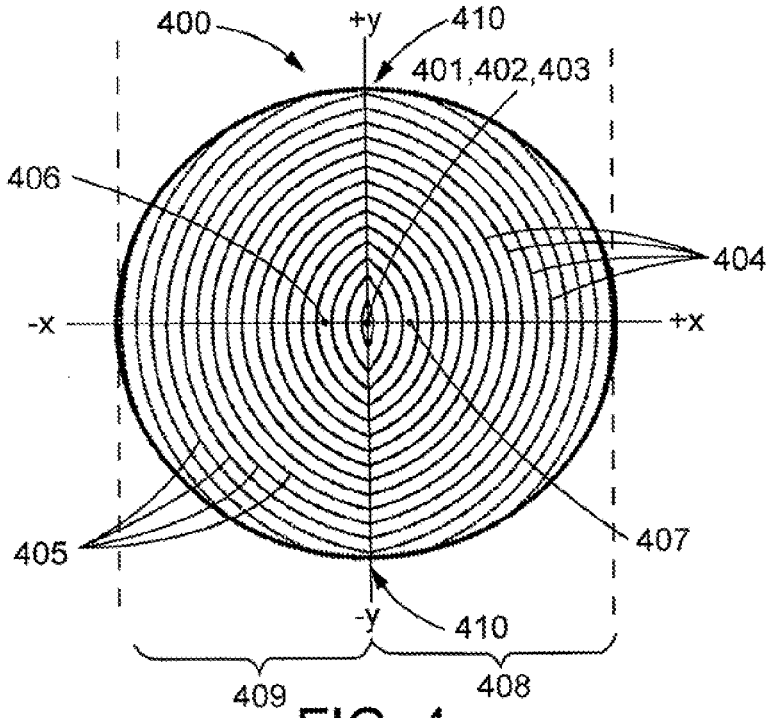
FIG. 4

POLISHING PAD WITH OFFSET CONCENTRIC GROOVING PATTERN AND METHOD FOR POLISHING A SUBSTRATE THEREWITH

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, layers of metal or glass, and the like. In certain steps of the wafer fabrication process, the uppermost surface of the process layers is desirably planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer typically are rotated above the rotating polishing pad on the CMP tool's polishing table. A polishing composition (also referred to as a polishing slurry) generally is introduced between the rotating wafer and the rotating polishing pad during the polishing process. The polishing composition typically contains one or more chemicals that interact with or dissolve portions of the uppermost wafer layer(s) and one or more abrasive materials that physically remove portions of the layer(s). The wafer and the polishing pad can be rotated in the same direction, in opposite directions, or one of the wafer or polishing pad can be rotated while the other one of the wafer or polishing pad remains stationary. The carrier also can oscillate across the polishing pad on the polishing table. The rotation scheme is chosen according to the particular polishing process being carried out.

The polishing pad typically is made of a rigid, microporous material, and the polishing pad typically performs several useful functions during a polishing process, such as polishing slurry transport, distribution of applied pressure across a substrate to be polished, and removal of material abraded from substrate. The physical and mechanical properties of the polishing pad, such as the polishing pad material, the surface topography of the polishing pad (e.g., micro- and macro-structures, such as perforations, pores, textures, grooves, depressions, etc.), and the like, in combination with the properties of the composition of the polishing slurry (e.g., reactivity, abrasiveness, etc.), can affect various aspects of the CMP process, including the polishing rate and the quality of the polished substrate (e.g., degree of planarity, and number and type of defects). The polishing rate, in particular, directly relates to the throughput of the CMP process, such that the polishing rate is important for cost-of-ownership considerations.

Attempts in the art to increase throughput by way of increasing the polishing rate have typically involved adjusting the physical and mechanical properties of the polishing pad material or the micro-structure of the polishing pad surface, e.g., using different materials and pad conditioning processes, often resulting in various undesirable tradeoffs, such as increased defects on the surface of the polished substrate and/or reduced life of the polishing pad. While employing macro-structures on the polishing pad surface, such as grooving patterns, has had some success in improving some characteristics of the polishing process, such as the lifetime of the polishing pad in some instances (see, for example, U.S. Pat. No. 6,520,847 to Osterheld et al.), other properties of the polishing process, such as the polishing rate of the substrate, generally have not been adequately improved by conventional grooving patterns to sufficiently increase throughput, while still achieving a polished substrate with a high level of planarity and low defects. Moreover, many conventional grooving patterns are not adequate for retaining the polishing slurry on the polishing pad for a sufficient amount of time thereby requiring a larger amount of polishing slurry to be used in a polishing process, which undesirably adds to the overall manufacturing costs.

Thus, there remains a need in the art for improved polishing pads that retain the polishing slurry for a sufficient amount of time and also achieve a commercially viable polishing rate, while at the same time producing a polished substrate having, advantageous surface properties, such as high planarity and low defects.

BRIEF SUMMARY OF THE INVENTION

The invention provides a polishing pad comprising, consisting essentially of or consisting of an axis of rotation, a polishing surface, and a plurality of grooves set into the polishing surface, wherein the plurality of grooves is composed of at least (a) a first plurality of concentric, grooves having a first center of concentricity, and (b) a second plurality of concentric grooves having a second center of concentricity, and wherein (1) the first center of concentricity is not coincident with the second center of concentricity, (2) the axis of rotation of the polishing pad is not coincident with at least one of the first center of concentricity and the second center of concentricity, (3) the plurality of grooves does not consist of a continuous spiral groove, and (4) the polishing surface does not comprise a mosaic groove pattern.

The invention also provides a method of chemical-mechanically polishing a substrate, which method comprises, consists essentially of, or consists of (a) contacting a substrate with a chemical-mechanical polishing composition and a polishing pad, (1) moving the polishing pad relative to the substrate with the chemical-mechanical polishing composition therebetween, and (c) abrading at least a portion of the substrate to polish the substrate, wherein the polishing pad comprises, consists essentially of, or consists of an axis of rotation, a polishing surface, and a plurality of grooves set into the polishing surface, wherein the plurality of grooves is composed of at least (a) a first plurality of concentric grooves having a first center of concentricity, and (b) a second plurality of concentric, grooves having a second center of concentricity, and wherein (1) the first center of concentricity is not coincident with the second center of concentricity, (2) the axis of rotation of the polishing pad is not coincident with at least one of the first center of concentricity and the second center of concentricity, (3) the plurality of grooves does not consist of a continuous spiral groove, and (4) the polishing surface does not comprise a mosaic groove pattern.

BRIEF DESCRIPTION OF THE. DRAWINGS

FIG. 1 illustrates a polishing pad according to an embodiment of the invention. FIG. 1 is a view of the polishing surface of the polishing pad from a perspective perpendicular to the polishing surface. The polishing pad of FIG. 1 is a mirror image of the polishing pad of FIG. 2. FIG. 1 contains a virtual x-axis and a virtual y-axis for ease of reference.

FIG. 2 illustrates a polishing pad according to an embodiment of the invention. FIG. 2 is a view of the polishing surface of the polishing pad from a perspective perpendicular to the polishing surface. The polishing pad of FIG. 2 is a mirror image of the polishing, pad of FIG. 1. FIG. 2 contains a virtual x-axis and a virtual y-axis for ease of reference.

FIG. 3 illustrates a polishing pad according to an embodiment of the invention. FIG. 3 is a view of the polishing surface of the polishing pad from a perspective perpendicular to the polishing surface. FIG. 3 contains a virtual x-axis and a virtual y-axis for ease of reference.

FIG. 4 illustrates a polishing pad according to an embodiment of the invention. FIG. 4 is a view of the polishing, surface of the polishing pad from a perspective perpendicular to the polishing surface. FIG. 4 contains a virtual x-axis and a virtual y-axis for ease of reference.

DETAILED DESCRIPTION OF THE INVENTION

Figure 5:
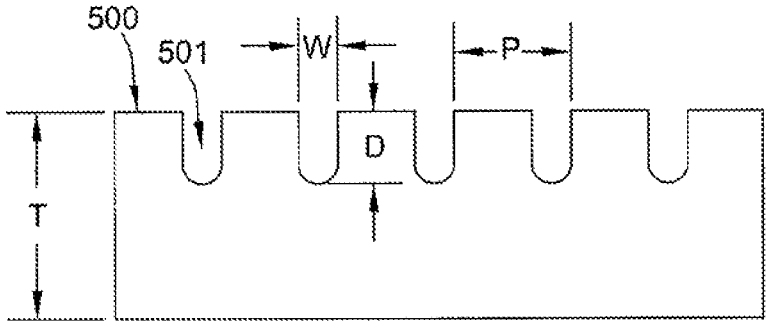
FIG. 5 is a cross-sectional view of a polishing pad according to the invention.

The invention is illustrated by way of a discussion of FIGS. 1-8 but, of course, illustration in this manner should not be construed as in any way limiting the scope of the invention. The features of the polishing pads described with respect to FIGS. 1-6 and 8 are general to a polishing pad of the invention, and therefore the described features can be combined in any suitable manner to result in a polishing pad of the invention. In this regard, FIGS. 1-6 and 8 are merely illustrative of the types of grooving patterns of polishing pads of the invention so as to facilitate an understanding, of the inventive grooving, patterns; however, the dimensions and proportions represented in FIGS. 1-6 and 8 are not necessarily representative of the actual dimensions and proportions of a polishing pad of the invention.

The invention provides a polishing pad comprising, consisting essentially of or consisting of an axis of rotation, a polishing surface, and a plurality of grooves set into the polishing surface, wherein the plurality of grooves is composed of at least (a) a first plurality of concentric, grooves having a, first center of concentricity, and (b) a second plurality of concentric grooves having a second center of concentricity, and wherein (1) the first center of concentricity is not coincident with the second center of concentricity, (2) the axis of rotation of the polishing pad is not coincident with at least one of the first center of concentricity and the second center of concentricity, (3) the plurality of grooves does not consist of a continuous spiral groove, and (4) the polishing surface does not comprise a mosaic groove pattern.

The plurality of grooves can comprise, consist essentially of, or consist of any suitable number of pluralities of concentric grooves. In this regard, although the features of the polishing pad of the invention typically are described herein with respect to a polishing pad having two pluralities of concentric grooves (i.e., a first plurality of concentric grooves and a second plurality of concentric grooves), the polishing pad of the invention is not limited to two pluralities of concentric grooves. For example, the plurality of grooves can comprise at least two pluralities of concentric grooves, e.g., at least three, at least four, at least five, at least six, at least seven, at least eight, at least nine, or at least ten pluralities of concentric grooves. Each plurality of concentric grooves is concentric about a center of concentricity, such that the number of plurality of concentric grooves is the same as the number of centers of concentricity. For example, when the polishing pad contains at least four pluralities of concentric grooves, the polishing pad also contains at least four centers of concentricity.

The centers of concentricity can be separated from one another by any suitable distance. When the polishing pad contains more than two centers of concentricity, the distances recited herein can refer to the distance between adjacent centers of concentricity and/or the distance between non-adjacent centers of concentricity, and the distances can be the same or different. For example, the centers of concentricity can be separated by a distance of 0.1 cm or more, e.g., 0.2 cm or more, 0.3 cm or more, 0.4 cm or more, 0.5 cm or more, 0.6 cm or more, 0.7 cm or more, 0.8 cm or more, 0.9 cm or more, 1 cm or more, 1.2 cm or more, 1.4 cm or more, 1.6 cm or more, 1.8 cm or more, 2 cm or more, 2.2 cm or more, 2.4 cm or more, 2.6 cm or more, 2.8 cm or more, 3 cm or more, 3.2 cm or more, 3.4 cm or more, 3.6 cm or more, 3.8 cm or more, 4 cm or more, 4.2 cm or more, 4.4 cm or more, 4.6 cm or more, 4.8 cm or more, 5 cm or more, 5.2 cm or more, 5.4 cm or more, 5.6 cm or more, 5.8 cm or more, 6 cm or more, 6.2 cm or more, 6.4 cm or more, 6.6 cm or more, 6.8 cm or more, 7 cm or more, 7.2 cm or more, 7.4 cm or more, 7.6 cm or more, 7.8 cm or more, 8 cm or more, 8.2 cm or more, 8.4 cm or more, 8.6 cm or more, 8.8 cm or more, 9 cm or more, 9.2 cm or more, 9.4 cm or more, 9.6 cm or more, 9.8 cm or more, 10 cm or more, 1.0.2 cm or more, 10.4 cm or more, 10.6 cm or more 10.8 cm or more, 11 cm or more, 11.2 cm or more, 11.4 cm or more, 1.1.6 cm or more, 11.8 cm or more, 12 cm or more, 12.2 cm or more, 12.4 cm or more, 12.6 cm or more, 12.8 cm or more, 13 cm or more, 13.2 cm or more, 13.4 cm or more, 13.6 cm or more, 13.8 cm or more, 14 cm or more, 14.2 cm or more, 14.4 cm or more, 14.6 cm or more, 14.8 cm or more, 15 cm or more, 15.5 cm or more, 16 cm or more, 16.5 cm or more, 0.17 cm or more, 17.5 cm or more, 18 cm or more, 18.5 cm or more, 19 cm or more, 19.5 cm or more, 20 cm or more, 22 cm or more, 24 cm or more, 26 cm or more, 28 cm or more, 30 cm or more, 32 cm or more, 34 cm or more, 36 cm or more, 38 cm or more, 40 cm or more, 42 cm or more, 44 cm or more, 46 cm or more, or 48 cm or more. Alternatively, or in addition, the centers of concentricity can be separated by a distance of 50 cm or less, e.g., 48 cm or less, 46 cm or less, 44 cm or less, 42 cm or less, 40 cm or less, 38 cm or less, 36 cm or less, 34 cm or less, 32 cm or less, 30 cm or less, 28 cm or less, 26 cm or less, 24 cm or less, 22 cm or less, 20 cm or less, 19.5 cm or less, 19 cm or less, 18.5 cm or less, 18 cm or less, 17.5 cm or less, 17 cm or less, 16.5 cm or less, 16 cm or less, 15.5 cm or less, 15 cm or less, 14.8 cm or less, 14.6 cm or less, 14.4 cm or less, 14.2 cm or less, 14 cm or less, 13.8 cm or less, 13.6 cm or less, 13.4 cm or less, 13.2 cm or less, 13 cm or less, 12.8 cm or less, 12.6 cm or less, 12.4 cm or less, 12.2 cm or less, 12 cm or less, 11.8 cm or less, 11.6 cm or less, 11.4 cm or less, 11.2 cm or less, 11 cm or less, 10.8 cm or less, 10.6 cm or less, 10.4 cm or less, 10.2 cm or less, 10 cm or less, 9.8 cm or less, 9.6 cm or less, 9.4 cm or less, 9.2 cm or less, 9 cm or less, 8.8 cm or less, 8.6 cm or less, 8.4 cm or less, 8.2 cm or less, 8 cm or less, 7.8 cm or less, 7.6 cm or less, 7.4 cm or less, 7.2 cm or less, 7 cm or less, 6.8 cm or less, 6.6 cm or less, 6.4 cm or less, 6.2 cm or less, 6 cm or less, 5.8 cm or less, 5.6 cm or less, 5.4 cm or less, 5.2 cm or less, 5 cm or less, 4.8 cm or less, 4.6 cm or less, 4.4 cm or less 4.2 cm or less, 4 cm or less, 3.8 cm or less, 3.6 cm or less, 3.4 cm or less, 3.2 cm or less, 3 cm or less, 2.8 cm or less, 2.6 cm or less, 2.4 cm or less, 2.2 cm or less, 2 cm or less, 1.8 cm or less, 1.6 cm or less, 1.4 cm or less, 1.2 cm or less, 1 cm or less, 0.9 cm or less, 0.8 cm or less, 0.7 cm or less, 0.6 cm or less 0.5 cm or less, 0.4 cm or less, 0.3 cm or less, or 0.2 cm or less. Thus, the distance between centers of concentricity can be within the range bounded by any two attic foregoing endpoints. For example, the distance can be 2.6 cm to 12.8 cm, 20 cm to 40 cm, or 9.8 cm to 10.2 cm. In a preferred embodiment, the distance, between centers of concentricity (e.g., the distance between a first center of concentricity and a second center of concentricity) is 10 cm (e.g., 9.8 cm to 10.2 cm).

The polishing pad of the invention typically contains an axis of rotation, a geometric center axis of symmetry, a first center of concentricity, and a second center of concentricity. The axis of rotation, the geometric center, the axis of symmetry, and one of the first center of concentricity or second center of concentricity may be coincident or not coincident with one another in any desirable combination. For example, the axis of rotation and the geometric center can be coincident with one another, while the axis of symmetry is not coincident with either the axis of rotation or the geometric center. Moreover, the axis of rotation, the geometric center, and the axis of symmetry may be coincident or not coincident, in any desirable combination, with one of the first center of concentricity or the second center of concentricity. Preferably, the axis of rotation, the geometric center, and the axis of symmetry are coincident with one another, and preferably the axis of rotation, the geometric center, and the axis of symmetry are not coincident with either the first center of concentricity or the second center of concentricity.

With reference to FIG. 1, the polishing pad comprises a polishing surface 100, a plurality of grooves 104 and 105 set into the polishing surface 100, an axis of rotation 101, a geometric center 102, and an axis of symmetry 103. The axis of rotation 101, the geometric center 102, and the axis of symmetry 103 are all coincident with one another in FIG. 1. The plurality of grooves is composed of a first plurality of concentric grooves 104 having a first center of concentricity 106, and a second plurality of concentric grooves 105 having a second center of concentricity 107. Although, for brevity, only a portion of the grooves in FIG. 1 are labeled in each of the first and second pluralities of concentric grooves, it should be noted that all of the grooves that are concentric about the first center of concentricity 106 are part of the first plurality of concentric grooves 104, and all of the grooves that are concentric about the second center of concentricity 107 are part of the second plurality of concentric grooves 105. The first center of concentricity 106 is not coincident with the second center of concentricity 107, the axis of rotation 101 is not coincident with either the first center of concentricity 106 or the second center of concentricity 107, the plurality of grooves does not consist of a continuous spiral groove, and the plurality of grooves does not comprise a mosaic groove pattern.

The polishing pad of FIG. 2 is a mirror image of the polishing pad of FIG. 1. With reference to FIG. 2, the polishing pad comprises a polishing surface 200, a plurality of grooves 204 and 205 set into the polishing surface 200, an axis of rotation 201, a geometric center 202, and an axis of symmetry 203. The axis of rotation 201, the geometric center 202, and the axis of symmetry 203 are all coincident with one another in FIG. 2. The plurality of grooves is composed of a first plurality of concentric grooves 204 having a first center of concentricity 206, and a second plurality of concentric grooves 205 having a second center of concentricity 207. Although, for brevity, only a portion of the grooves in FIG. 2 are labeled in each of the first and second pluralities of concentric grooves, it should be noted that all of the grooves that are concentric, about the first center of concentricity 206 are part of the first plurality of concentric grooves 204, and all of the grooves that are concentric about the second center of concentricity 207 are part of the second plurality of concentric grooves 205. The first center of concentricity 206 is not coincident with the second center of concentricity 207, the axis of rotation 201 is not coincident with either the first center of concentricity 206 or the second center of concentricity 207, the plurality of grooves does not consist of a continuous spiral groove, and the plurality of grooves does not comprise a mosaic groove pattern.

With reference to FIG. 3, the polishing pad comprises a polishing surface 300, a plurality of grooves 304 and 305 set into the polishing surface 300, an axis of rotation 301, a geometric center 302, and an axis of symmetry 303. The axis of rotation 301, the geometric center 302, and the axis of symmetry 303 are all coincident with one another in FIG. 3. The plurality of grooves is composed of a first plurality of concentric grooves 304 having a first center of concentricity 306, and a second plurality of concentric grooves 305 having a second center of concentricity 307. Although, for brevity, only a portion of the grooves in FIG. 3 are labeled in each of the first and second pluralities of concentric grooves, it should be noted that all of the grooves that are concentric about the first center of concentricity 306 are part of the first plurality of concentric grooves 304, and all of the grooves that are concentric about the second center of concentricity 307 are part of the second plurality of concentric grooves 305. The first center of concentricity 306 is not coincident with the second center of concentricity 307, the axis of rotation 301 is not coincident with either the first center of concentricity 306 or the second center of concentricity 307, the plurality of grooves does not consist of a continuous spiral groove, and the plurality of grooves does not comprise a mosaic groove pattern.

With reference to FIG. 4, the polishing pad comprises a polishing surface 400, a plurality of grooves 404 and 405 set into the polishing surface 400, an axis of rotation 401, a geometric center 402, and an axis of symmetry 403. The axis of rotation 401, the geometric center 402, and the axis of symmetry 403 are all coincident with one another in FIG. 4. The plurality of grooves is composed of a first plurality of concentric grooves 404 having a first center of concentricity 406, and a second plurality of concentric grooves 405 having as second center of concentricity 407. Although, for brevity, only a portion of the grooves in FIG. 4 are labeled in each of the first and second pluralities of concentric grooves, it should be noted that all of the grooves that are concentric about the first center of concentricity 406 are part of the first plurality of concentric grooves 404, and all of the grooves that are concentric about the second center of concentricity 407 are part of the second plurality of concentric grooves 405. The first center of concentricity 406 is not coincident with the second center of concentricity 407, the axis of rotation 401 is not coincident with either the first center of concentricity 406 or the second center of concentricity 407, the plurality of grooves does not consist of a continuous spiral groove, and the plurality of grooves does not comprise a mosaic groove pattern.

The polishing pad of the invention can have any suitable shape. For example, the polishing pad can be substantially in the shape of a circle (i.e., circular), oval, square, rectangle, rhombus, triangle, continuous belt, polygon (e.g. pentagon, hexagon, heptagon, octagon, nonagon, decagon, etc.), and the like. As used herein, the term "substantially" in the context of the shape of the polishing pad means that the shape can vary in an insignificant way from a technical definition of the shape at issue, such that the overall shape would be considered by one of ordinarily skill in the art to resemble the given shape. For example, in the context of a polishing pad having a substantially circular shape, the radius of the polishing pad (as measured from the geometric center of the polishing pad to the outer edge of the pad) can vary in an insignificant manner (e.g., minor fluctuations) around the entire polishing pad, such that one of ordinarily skill in the art would still consider the polishing pad to have a circular shape, despite the situation in which the radius is not entirely constant around the entire polishing pad. In a preferred embodiment, the polishing pad is substantially in the shape of a circle, i.e., the polishing pad has a substantially circular shape.

When the polishing pad is substantially circular or substantially oval-shaped, the polishing pad can have any suitable radius R. When the polishing pad has an oval shape, the radii listed hereinbelow can refer to the long axis and/or the short axis of the oval shape. For example, the polishing pad can have a radius R that is 8 cm or more, e.g., 9 cm or more, 10 cm or more, 12 cm or more, 14 cm or more, 16 cm or more, 18 cm or more, 20 cm or more, 22 cm or more, 24 cm or more, 26 cm or more, 28 cm or more, 30 cm or more, 32 cm or more, 34 cm or more, 36 cm or more, 38 cm or more, 40 cm or more, 42 cm or more, 44 cm or more, 46 cm or more, 48 cm or more, or 50 cm or more. Alternatively, or in addition, the polishing pad can have a radius R that is 52 cm or less, e.g., 50 cm or less, 48 cm or less, 46 cm or less, 44 cm or less, 42 cm or less, 40 cm or less, 38 cm or less, cm or less, 34 cm or less, 32 cm or less, 30 cm or less, 28 cm or less, 26 cm or less, 24 cm or less, 22 cm or less, 20 cm or less, 18 cm or less, 16 cm or less, 14 cm or less, 12 cm or less, 10 cm or less, or 9 cm or less. Thus, the radius R of the polishing pad can be within the range bounded by any two of the foregoing endpoints. For example, the radius R can be within the range of 10 cm to 52 cm, 20 cm to 26 cm, or 18 cm to 24 cm. In a preferred embodiment, the radius R of the polishing pad is 24 cm to 26 cm.

The centers of concentricity can be offset from the axis of rotation of the polishing pad by any suitable distance. The offset distance can be expressed as a fraction of the radius R of the polishing pad, sometimes known in the art as the normalized off-center distance ("NOC" distance) (i.e., the measured distance from the axis of rotation to a center of concentricity divided by the radius R of the polishing pad). Although this feature of the invention is described with respect to a first center of concentricity and a second center of concentricity, the distances recited therefor are equally applicable to any other centers of concentricity that may be associated with the polishing pad of the invention, namely, third, fourth, fifth, sixth, seventh, eighth, ninth, and/or tenth centers of concentricity. The first center of concentricity is offset from the axis of rotation of the polishing pad by a first distance measured as a fraction of the radius R of the polishing pad of 0 R to 2 R, the second center of concentricity is offset from the axis of rotation of the polishing pad by a second distance measured as a fraction of the radius R of the polishing pad of 0 R to 2 R, and the first distance and the second distance can be the same or different provided that, when one of the first distance or the second distance is 0 R, the other of the first distance or the second distance is not 0 R. The first distance and/or the second distance is 0 R or more, e.g., 0.001 R or more, 0.005 R or more, 0.01 R or more, 0.015 R or more, 0.02 R or more, 0.025 R or more, 0.03 R or more, 0.035 R or more, 0.04 R or more, 0.045 R or more, 0.05 R or more, 0.055 R or more, 0.06 R or more, 0.065 R or more, 0.07 R or more, 0.075 R or more, 0.08 R or more, 0.085 R or more, 0.09 R or more, 0.095 R or more, 0.1 R or more, 0.15 R or more, 0.2 R or more, 0.25 R or more, 0.3 R or more, 0.35 R or more, 0.4 R or more, 0.45 R or more, 0.5 R or more, 0.55 R of more, 0.6 R or more, 0.65 R or more, 0.7 R or more, 0.75 R or more, 0.8 R or more, 0.85 R or more, 0.9 R or more, 0.95 R or more, 1 R or more, 1.05 R or more, 1.1 R or more, 1.15 R or more, 1.2 R or more, 1.25 R or more, 1.3 R or more, 1.35 R or more, 1.4 R or more, 1.45 R or more, 1.5 R or more, 1.55 R or more, 1.6 R or more, 1.65 R or more, 1.7 R or more, 1.75 R or more, 1.8 R or more, 1.85 R or more, 1.9 R or more, or 1.95 R or more. Alternatively, or in addition, the first distance and/or the second distance is 2 R or less, e.g., 1.95 R or less, 1.9 R or less, 1.85 R or less, 1.8 R or less, 1.75 R or less, 1.7 R or less, 1.65 R or less, 1.6 R or less, 1.55 R or less, 1.5 R or less, 1.45 R or less, 1.4 R or less, 1.35 R or less, 1.3 R or less, 1.25 R or less, 1.2 R or less, 1.15 R or less, 1.1 R or less, 1.05 R or less, 1 R or less, 0.95 R or less, 0.9 R or less, 0.85 R or less, 0.8 R or less, 0.75 R or less, 0.7 R or less, 0.65 R or less, 0.6 R or less, 0.55 R or less, 0.5 R or less, 0.45 R or less, 0.4 R or less, 0.35 R or less, 0.3 R or less, 0.25 R or less, 0.2 R or less, 0.15 R or less, 0.1 R or less, 0.095 R or less, 0.09 R or less, 0.085 R or less, 0.08 R or less, 0.075 R or less, 0.07 R or less, 0.065 R or less, 0.06 R or less, 0.055 R or less, 0.05 R or less, 0.045 R or less, 0.04 R or less, 0.035 R or less, 0.03 R or less, 0.025 R or less, 0.02 R or less, 0.015 R or less, 0.01 R or less, or 0.005 or less. Thus, the first distance and/or the second distance can be within the range bounded by any two of the foregoing endpoints. For example, the first distance and/or the second distance can be 0.01 R to 0.8 R, 0.5 R to 1 R, or 0.25 R to 0.55 R. In a preferred embodiment, the first distance and the second distance are 0.15 R to 0.25 R.

The centers of concentricity can be located within the confines of the polishing pad, and/or the centers of concentricity can be located beyond the confines of the polishing pad. With respect to the radius R of the polishing pad, the centers of concentricity can be ≤1 R and/or ≥1 R. In the context of a polishing pad of the invention having at least two centers of concentricity, the polishing pad can be characterized by one of the following conditions: (a) the first distance and the second distance are ≤1 R, (h) the first distance and the second distance are ≥1 R, or (c) the first distance is ≤1 R and the second distance is ≥1 R. Of course, when the polishing pad contains more than two centers of concentricity, the additional centers of concentricity can be located within the confines of polishing pad and/or outside of the confines of the polishing pad, in any desirable combination.

With reference to FIG. 1, the polishing pad has a substantially circular shape, and the first center of concentricity 106 and the second center of concentricity 107 are offset from the axis of rotation 101 of the polishing pad such that the first distance and the second distance are 1 R.

With reference to FIG. 2, the polishing pad has a substantially circular shape, and the first center of concentricity 206 and the second center of concentricity 207 are offset from the axis of rotation 201 of the polishing pad such that the first distance and the second distance are 1 R.

With reference to FIG. 3, the polishing pad has a substantially circular shape, and the first center of concentricity 306 and the second center of concentricity 307 are offset from the axis of rotation 301 of the polishing pad such that the first distance and the second distance are 1 R.

With reference to FIG. 4, the polishing pad has a substantially circular shape, and the first center of concentricity 406 and the second center of concentricity 407 are offset from the axis of rotation 401 of the polishing pad such that the first distance and the second distance are ≤1 R.

In some embodiments of the invention, when the plurality of grooves is extended infinitely in the plane of the polishing surface, each of the pluralities of concentric grooves are symmetric with respect to the other pluralities of concentric grooves by way of a rotation about an axis of symmetry perpendicular to the polishing surface. For example, when the number of centers of concentricity is X, each of the pluralities of concentric grooves can be symmetric with respect to the other pluralities of concentric grooves by way of a 360°/X rotation about an axis of symmetry perpendicular to the polishing surface. In the situation where the polishing pad has two centers of concentricity having, a first plurality of concentric grooves and a second plurality of concentric grooves, when the plurality of grooves is extended infinitely in the plane of the polishing surface, the first plurality of concentric grooves is symmetric with the second plurality of concentric grooves by way of a 180° rotation (i.e., 360°/2) about an axis of symmetry perpendicular to the polishing surface.

With reference to FIG. 1, when the plurality of grooves 104 and 105 is extended infinitely in the plane of the polishing surface 100, the first plurality of concentric grooves 104 is symmetric with the second plurality of concentric grooves 105 by way of a 180° rotation about the axis of symmetry 103 that is perpendicular to the polishing surface 100.

With reference to FIG. 2, when the plurality of grooves 204 and 205 is extended infinitely in the plane of the polishing surface 200, the first plurality of concentric grooves 204 is symmetric with the second plurality of concentric grooves 205 by way of a 180° rotation about the axis of symmetry 203 that is perpendicular to the polishing surface 200.

With reference to FIG. 3, when the plurality of grooves 304 and 305 is extended infinitely in the plane of the polishing surface 300, the first plurality of concentric grooves 304 is symmetric with the second plurality of concentric grooves 305 by way of a 180° rotation about the axis of symmetry 303 that is perpendicular to the polishing surface 300.

With reference to FIG. 4, when the plurality of grooves 404 and 405 is extended infinitely in the plane of the polishing surface 409, the first plurality of concentric grooves 404 is symmetric with the second plurality of concentric grooves 405 by way of a 180° rotation about the axis of symmetry 403 that is perpendicular to the polishing surface 400.

In some embodiments of the invention, when the plurality of grooves is extended infinitely in the plane of the polishing surface, the first plurality of concentric grooves is symmetric with the second plurality of concentric grooves by way of a first mirror plane that (a) is perpendicular to the polishing surface and (b) does not intersect with either the first center of concentricity or the second center of concentricity.

With reference to FIG. 3, when the plurality of grooves 304 and 305 is extended infinitely in the plane of the polishing surface 309, the first plurality of concentric grooves 304 is symmetric with the second plurality of concentric grooves 305 by way of a first mirror plane that (a) is perpendicular to the polishing surface 390 and (b) does not intersect with either the first center of concentricity 306 or the second center of concentricity 307. In FIG. 3, the first mirror plane is located along the virtual y-axis.

With reference to FIG. 4, when the plurality of grooves 404 and 405 is extended infinitely in the plane of the polishing surface 400, the first plurality of concentric grooves 404 is symmetric with the second plurality of concentric grooves 405 by way of a first mirror plane that (a) is perpendicular to the polishing surface 400 and (b) does not intersect with either the first center of concentricity 406 or the second center of concentricity 407. In FIG. 4, the first mirror plane is located along a virtual y-axis.

In some embodiments of the invention, when the plurality of grooves is extended infinitely in the plane of the polishing surface, the first plurality of concentric grooves is symmetric with the second plurality of concentric grooves by way of a second mirror plane that (a) is perpendicular to the polishing, surface and (b) intersects with both the first center of concentricity and the second center of concentricity.

With reference to FIG. 3, when the plurality of grooves 304 and 305 is extended infinitely in the plane of the polishing surface 300, the first plurality of concentric grooves 304 is symmetric with the second plurality of concentric grooves 305 by way of a second minor plane that (a) is perpendicular to the polishing surface 300 and (b) intersects with both the first center of concentricity 306 and the second center of concentricity 307. In FIG. 3, the second mirror plane is located along a virtual x-axis.

With reference to PG. 4, when the plurality of grooves 404 and 405 is extended infinitely in the plane of the polishing surface 400, the first plurality of concentric grooves 404 is symmetric with the second plurality of concentric grooves 405 by way of a second mirror plane that (a) is perpendicular to the polishing surface 400 and (b) intersects with both the first center of concentricity 406 and the second center of concentricity 407. In FIG. 4, the second mirror plane is located along a virtual x-axis.

In some embodiments of the invention, when the plurality of grooves is extended infinitely in the plane of the polishing, surface, the first plurality of concentric grooves is not symmetric with the second plurality of concentric grooves by way of a mirror plane that is perpendicular to the polishing surface.

With reference to FIG. 1, when the plurality of grooves 104 and 105 is extended infinitely hi the plane of the polishing, surface 100, the first plurality of concentric grooves 104 is not symmetric with the second plurality of concentric grooves 105 by way of a mirror plane that is perpendicular to the polishing surface 100.

With reference to FIG. 2, when the plurality of grooves 204 and 205 is extended infinitely in the plane of the polishing surface 200, the first plurality of concentric grooves 204 is not symmetric with the second plurality of concentric grooves 205 by way of a mirror plane that is perpendicular to the polishing surface 200.

In some embodiments of the invention, at least as portion of the grooves in the plurality of grooves is an arc having a shape selected from the group consisting of substantially circular, substantially semi-circular, substantially parabolic, substantially oval, and combinations thereof. In preferred embodiments of the invention, the shape is substantially circular or substantially semi-circular, each respective groove in the first plurality of concentric grooves has a substantially constant radius with respect to the first center of concentricity, and each respective groove in the second plurality of concentric, grooves has a substantially constant radius with respect to the second center of concentricity. Preferably, all of the grooves in the plurality of grooves have the shape as described herein.

The term "substantially" in relation to the shape of the grooves, as defined herein, means that the grooves have a shape that would be recognized by one of ordinary skill in the art to resemble the recited shape, despite a situation in which the recited shape technically may not meet a rigid, textbook definition of the recited shape. For example, in the situation where a given arc groove does not have a constant radius with respect to a center of concentricity, but the radius has a substantially constant radius that varies only insignificantly such that the overall shape would be considered by the ordinarily skill artisan to resemble a circular or semi-circular shape, then such an arc would meet the definition of "substantially circular" or "substantially semi-circular" as used herein. The terms "circular" and "semi-circular" are interchangeably used herein to describe an arc groove that has a substantially constant radius with respect to a given center of concentricity. The term "substantially constant radius" as used herein means that the radius an arc groove varies only insignificantly such that the overall shape of the arc groove would be considered by one of ordinarily skill in the art to resemble a circular or semi-circular shape.

The plurality of grooves can have any suitable cross-sectional shape. The cross-sectional shape of the grooves, as used herein, is the shape formed by the combination of the groove walls and groove bottom. For example, the cross-sectional shape of the grooves can be U-shaped. V-shaped, square-shaped (i.e., the groove walls and bottoms are formed at 90° angles), and the like. With reference to FIG. 5, the grooves have a cross-sectional shape that is U-shaped.

Figure 6:
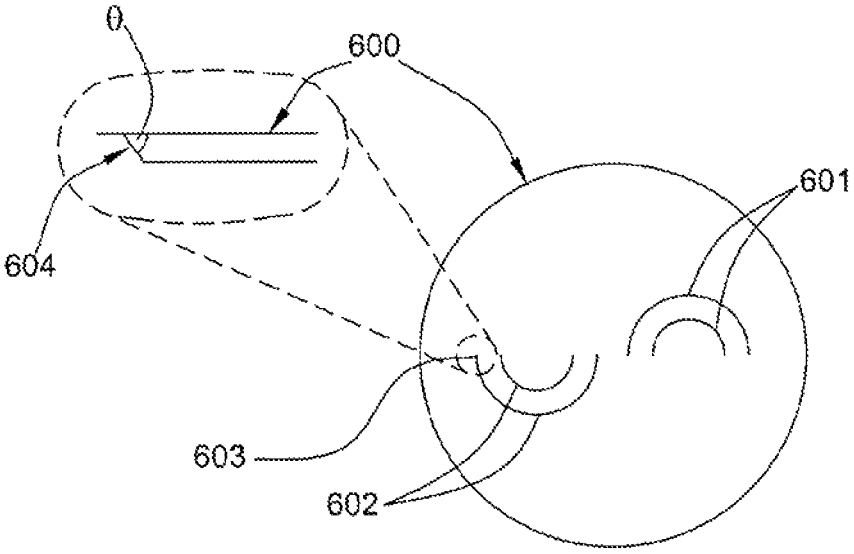
FIG. 6 is a profile view of an end of a groove, illustrating the angle formed between the wall that joins the groove bottom with the polishing surface at the end of the groove.

When one of more grooves of the plurality of grooves has an end that terminates on the polishing surface (i.e., within the confines of the polishing pad and not at the edge of the polishing pad), the end of the groove typically is joined to the polishing surface by way of a wall having any suitable angle with respect to the plane of the polishing surface. With reference to FIG. 6, the polishing pad comprises a polishing surface 600, a first plurality of concentric grooves 601, a second plurality of concentric grooves 602, and at least one groove end 603 that terminates on the polishing surface. The wall 604 that joins the groove end with the polishing surface 600 makes an angle θ with respect to the polishing surface 600, wherein the angle θ can be any suitable angle. For example, the angle θ can be 10° or more, e.g., 20° or more, 30° or more, 40° or more, 50° or more, 60° or more, 70° or more, 80° or more, or 90°. Alternatively, or in addition, the angle θ can be 90° or less, e.g., 80° or less, 70° or less, 60° or less, 50° or less, 40° or less, 30° or less, or 20° or less. Thus, the angle θ can be within the range bounded by any two of the foregoing endpoints. For example, the angle θ can be 20° to 80°, 10° to 40°, or 70° to 90°. Preferably, the angle it is 90° (e.g., 90° or more).

In some embodiments, one of the following conditions is satisfied: (a) at least one groove in a plurality of concentric grooves (e.g., the first plurality of concentric grooves or second plurality of concentric grooves) completes a closed arc around the respective center of concentricity (e.g., the first center of concentricity or the second center of concentricity, respectively), or (b) none of the grooves in a plurality of concentric grooves (e.g., the first plurality of concentric grooves or second plurality of concentric grooves) completes a closed arc around the respective center of concentricity (e.g., the first center of concentricity or the second center of concentricity, respectively).

With reference to FIG. 1, at least a portion of the grooves in the plurality of grooves 104 and 105 is an arc having a shape that is substantially circular or substantially semi-circular, each respective groove in the first plurality of concentric grooves 104 has a substantially constant radius with respect to the first center of concentricity 106, and each respective groove in the second plurality of concentric grooves 105 has a substantially constant radius with respect to the second center of concentricity 107. In FIG. 1, none of the grooves in the first plurality of concentric grooves 104 or second plurality of concentric grooves 105 completes a closed arc around the first center of concentricity 106 or the second center of concentricity 107, respectively.

With reference, to FIG. 2, at least a portion of the grooves in the plurality of grooves 204 and 205 is an arc having a shape that is substantially circular or substantially semi-circular, and each respective groove in the first plurality of concentric grooves 204 has a substantially constant radius with respect to the first, center of concentricity 206, and each respective groove in the second plurality of concentric grooves 205 has a substantially constant radius with respect to the second center of concentricity 207. In FIG. 2, none of the grooves in the first plurality of concentric grooves 204 or second plurality of concentric grooves 205 completes a closed arc around the first center of concentricity 2416 or the second center of concentricity 207, respectively.

With reference to FIG. 3, at least a portion of the grooves in the plurality of grooves 304 and 305 is an arc having a shape that is substantially circular or substantially semi-circular, and each respective, groove in the first plurality of concentric grooves 304 has a substantially constant radius with respect to the first center of concentricity 306, and each respective groove in the second plurality of concentric grooves 305 has a substantially constant radius with respect to the second center of concentricity 307. In FIG. 3, at least one groove in the first plurality of concentric grooves 304 completes a closed arc around the first center of concentricity 306, and at least one groove in the second plurality of concentric grooves 305 completes a closed, arc around the second center of concentricity 307.

With reference to FIG. 4, at least a portion of the grooves in the plurality of grooves 404 and 405 is an arc having a shape that is substantially circular or substantially semi-circular, and each respective groove in the first plurality of concentric grooves 404 has a substantially constant radius with respect to the first center of concentricity 406, and each respective groove in the second plurality of concentric grooves 405 has a substantially constant radius with respect to the second center of concentricity 407. In FIG. 4, none of the grooves in the first plurality of concentric grooves 404 or second plurality of concentric grooves 405 completes a closed arc around the first center of concentricity 406 or the second center of concentricity 407, respectively.

The polishing pad of the invention can have any suitable thickness T, as defined by the distance between the polishing surface and the bottom surface of the polishing pad (see FIG. 5). For example, the thickness T can be 500 μm or more, e.g. 600 μm or more, 700 μm or more, 800 μm or more, 900 μm or more, 1000 μm or more, 1100 μm or more, 1200 μm or more, 1300 μm or more, 1400 μm or more, 1500 μm or mom, 1600 μm or more, 1700 μm or more, 1800 μm or more, 1900 μm or more, 2000 μm or more, 2100 μm or more, 2200 μm or more, 2300 μm or more, or 2400 μm or more. Alternatively, or in addition, the thickness T can be 2500 μm or less, e.g., 2400 μm or less, 2300 μm or less, 2200 μm or less, 2100 μm or less, 2000 μm or less, 1900 μm or less, 1800 μm or less, 1700 μm or less, 1600 μm or less, 1500 μm or less, 1400 μm or less, 1300 μm or less, 1200 μm or less, 1100 μm or less, 1000 μm or less, 900 μm or less, 800 urn or less, 700 μm or less, or 600 μm or less. Thus, the thickness T of the polishing pad can be within the range bounded by any two of the foregoing endpoints. For example, the thickness T can be 500 μm to 1200 μm, 800 μm to 2000 μm, or 600 μm to 900 μm.

Each groove in the plurality of grooves can have any suitable depth D, any suitable width W, and can be separated by an adjacent groove by any suitable pitch P. The depth, width, and pitch of each groove in the plurality of grooves can be constant or can vary. When the depth, width, and/or pitch vary, the variation can be systematic or random within the same groove and/or with respect to other grooves. See FIG. 5, which depicts polishing surface 500, grooves 501, polishing pad thickness T, groove width W, groove depth D, and groove pitch P.

For example, in the situation where the polishing pad has at least a first plurality of concentric grooves and a second plurality of concentric grooves, the polishing pad can be characterized as follows: (i) the polishing pad has a thickness T, (ii) each groove in the first plurality of concentric grooves has a first depth, a first width, and is separated from an adjacent groove by a first pitch, and (iii) each groove in the second plurality of concentric grooves has a second depth, a second width, and is separated from an adjacent groove by a second pitch, and wherein one or more of the following conditions is satisfied: (a) the first depth and the second depth measured as a fraction of the thickness T of the polishing pad independently are 0.01 T to 0.99 T and can be the same or different, and the first depth, the second depth, or both, either is constant or varies within the first plurality of concentric grooves, the second plurality of concentric grooves, or both, (b) the first width and the second width independently are 0.005 cm to 0.5 cm and can be the same or different, and the first width, the second width, or both, either is constant or varies within the first plurality of concentric grooves, the second plurality of concentric grooves, or both, and (c) the first pitch and the second pitch independently are 0.005 cm to 1 cm and can be the same or different, and the first pitch, the second pitch, or both, either is constant or varies within the first plurality of concentric grooves, the second plurality of concentric grooves, or both. Although the thickness T of the polishing pad, and the depth, width, and pitch of the grooves is described herein in relation to the situation in which a polishing pad has two pluralities of grooves (i.e., a first plurality of concentric grooves and a second plurality of concentric grooves), the description is equally applicable to the situation in which the polishing pad can have, e.g., three, four, five, six, seven, eight, nine, or ten pluralities of grooves. For example, the polishing pad may have a third plurality of concentric grooves, wherein each groove in the third plurality of concentric grooves has a third depth, a third width, and is separated from an adjacent groove by a third pitch, etc.

Each groove in the plurality of grooves independently can have any suitable depth measured as a fraction of the thickness T of the polishing pad. For example, the depth of each groove can independently be 0.01 T or more, e.g., 0.05 T or more, 0.1 T or more, 0.15 T or more, 0.2 T or more, 0.25 T or more, 0.3 T or more, 035 T or more, 0.4 T or more, 0.45 T or more, 0.5 T or more, 0.55 T or more, 0.6 T or more, 0.65 T or more, 0.7 T or more, 0.75 T or more, 0.8 T or more, 0.85 T or more, 0.9 T or more, 0.95 T or more, or 0.99 T or more. Alternatively, or in addition, the depth of each groove can independently be 0.99 T or less. e.g., 0.95 T or less, 0.9 T or less, 0.85 T or less, 0.8 T or less, 0.75 T or less, 0.7 T or less, 0.65 T or less, 0.6 T or less, 0.55 T or less, 0.5 T or less, 0.45 Tor less, 0.4 T or less, 0.35 T or less, 0.3 T or less, 0.25 T or less, 0.2 T or less, 0.15 T or less, 0.1 T or less, 0.05 T or less, or 0.01 T or less thus, the depth of each groove can independently be within the range bounded by any two of the foregoing endpoints. For example, the depth can be 0.2 T to 0.8 T, 0.75 T to 0.85 T, or 0.4 T to 0.55 T.

Each grove in the plurality of grooves independently can have any suitable depth expressed as a distance measured from the polishing surface to the bottom of the groove. For example, the depth of each groove can independently be 10 μm or more, e.g., 50 μm or more, 100 μm or more, 1.50 μm or more, 200 μm or more, 250 μm or more, 300 μm or more, 350 μm or more, 400 μm or more, 450 μm or more, 500 μm or more, 550 μm or more, 600 μm or more, 650 μm or more, 700 μm or more, 750 μm or more, 800 μm or more, 850 μm or more, 900 μm or more, 950 μm or more, 1000 μm or more, 1050 μm or more, 1100 μm or more, 1150 μm or more, 1200 μm or more, 1250 μm or more, 1300 μm or more, 1350 μm or more, 1400 μm or more, 1450 μm or more, 1500 μm or more, 1550 μm or more, 1600 μm or more, 1650 μm or more, 1700 μm or more 1750 μm or more, 1800 μm or more, 1850 μm or more, 1900 μm or more, 1950 μm or more, 2000 μm or more, 2100 μm or more, 2200 μm or more, 2300 μm or more, 2400 μm or more, 2500 μm or more, 2600 μm or more, 2700 μm or more, 2800 μm or more, 2900 μm or more, 3000 μm or more, 31.00 μm or more, 3200 μm or more, 3300 μm or more, 3400 μm or MOW, 3500 μm or more, 3600 μm or more, 3700 μm or more, 3800 μm or more, 3900 μm or more, 4000 μm or more, 4100 μm or more, 4200 μm or more, 4300 μm or more, 4400 μm or more, 4500 μm or more, 4600 μm or more, 4700 μm or more, 4800 μm or more, 4900 μm or more, or 5000 μm or more. Alternatively, or in addition, the depth of each groove can independently be 5000 μm or less, e.g., 4900 μm or less, 4800 μm or less, 4700 μm or less, 4600 μm or less, 4500 μm or less, 4400 μm or less, 4300 μm or less, 4200 μm or less, 4100 μm or less, 4000 μm or less, 3900 μm or less, 3800 μm or less, 3700 μm or less, 3600 μm or less, 3500 μm or less, 3400 μm or less, 3300 μm or less, 3200 μm or less, 3100 μm or less, 3000 μm or less, 2900 μm or less, 2800 μm or less, 2700 μm or less, 2600 μm or less, 2500 μm or less, 2400 μm or less, 2300 μm or less, 2200 μm or less, 2100 μm or less, 2.000 μm or less, 1950 μm or less, 1900 μm or less, 1850 μm or less, 1800 μm or less, 1750 μm or less, 1700 μm or less, 1650 μm or less, 1600 μm or less, 1550 μm or less, 1500 μm or less, 1450 μm or less, 1400 μm or less, 1350 μm or less, 1300 μm or less, 1250 μm or less, 1200 μm or less, 1150 μm or less, 1100 μm or less, 1050 μm or less, 1000 μm or less, 950 μm or less, 900 μm or less, 850 μm or less, 800 μm or less, 750 μm or less, 700 μm or less, 650 μm or less, 600 μm or less, 550 μm or less, 500 μm or less, 450 μm or less, 400 μm or less, 350 μm or less, 300 μm or less, 250 μm or less, 200 μm or less, 150 μm or less, 100 μm or less, 20 μm or less, or 10 μm or less. Thus, the depth of each groove can independently be within the range bounded by any two of the foregoing endpoints. For example, the depth can be 200 μm to 800 μm, 2500 μm to 4800 μm, or 1050 μm to 1250 μm. Preferably, the depth of each groove is independently 750 μm to 800 μm.

Each groove in the plurality of grooves independently can have any suitable width. For example, the width of each groove can independently be 10 μm or more, e.g., 50 μm or more, 100 μm or more, 150 μm or more, 200 μm or more, 250 μm or more, 300 μm or more, 350 μm or more, 400 μm or more, 450 μm or more, 500 μm or more, 550 μm or more, 600 μm or more, 650 μm or more, 700 μm or more, 750 μm or more, 800 μm or more, 850 μm or more, 900 μm or more, 950 μm or more, 1000 μm or more, 1050 μm or more, 1100 μm or more, 1150 μm or more, 1200 μm or more, 1250 μm or more, 1300 μm or more, 1350 μm or more, 1400 μm or more, 1450 μm or more, 1500 μm or more, 1550 μm or more, 1600 μm or more, 1650 μm or more, 1700 μm or more, 1750 μm or more, 1800 μm or more, 1850 μm or more, 1900 μm or more, 1950 μm or more, 2000 μm or more, 2100 μm or more, 2200 μm or more, 2300 μm or more, 2400 μm or more, 2500 μm or more, 2600 μm or more, 2700 μm or more, 2800 μm or more, 2900 μm or more, 3000 μm or more, 3100 μm or more, 3200 μm or more, 3300 μm or more, 3400 μm or more, 3500 μm or more, 3600 μm or more, 3700 μm or more, 3800 μm or more, 3900 μm or more, 4000 μm or more, 4100 μm or more, 4200 μm or more, 4300 μm or more, 4400 μm or more, 4500 μm or more, 4600 μm or more, 4700 μm or more, 4800 μm or more, 4900 μm or more, or 5000 μm or more, Alternatively, or in addition, the width of each groove can independently be 5000 μm or less, e.g., 4900 μm or less, 4800 μm or less, 4700 μm or less, 4600 μm or less, 4500 μm or less, 4400 μm or less, 4300 μm or less, 4200 μm or less, 4100 μm or less, 4000 μm or less, 3900 μm or less, 3800 μm or less, 3700 μm or less, 3600 μm or less, 3500 μm or less, 3400 μm or less, 3300 μm or less, 3200 μm or less, 3100 μm or less, 3000 μm or less, 2900 μm or less, 2800 μm or less, 2700 μm of less, 2600 μm or less, 2500 μm or less, 2400 μm or less, 2300 μm or less, 2200 μm or less, 2100 μm or less, 2000 μm or less, 1950 μm or less, 1900 μm or less, 1850 μm or less, 1800 μm or less, 1750 μm or less, 1700 μm or less, 1650 μm or less, 1600 μm or less, 1550 μm or less, 1500 μm or less, 1450 μm or less, 1400 μm or less, 1350 μm or less, 1300 μm or less, 1250 μm or less, 1200 μm or less, 1150 μm or less, 1100 μm or less, 1050 μm or less, 1000 μm or less, 950 μm or less, 900 μm or less, 850 μm or less, 800 μm or less, 750 μm or less, 700 μm or less, 650 μm or less, 600 μm or less, 550 μm or less, 500 μm or less, 450 μm or less, 400 μm or less, 350 μm or less, 300 μm or less, 250 μm or less, 200 μm or less, 150 μm or less, 100 μm or less, 20 μm or less, or 10 μm or less. Thus, the width of each groove can independently be within the range bounded by any two of the foregoing endpoints. For example, the width can be 200 μm to 800 μm, 1700 μm to 4800 μm, or 650 μm to 850 μm. Preferably, the width of each groove independently is 500 μm to 550 μm.

Each groove in the plurality of grooves can be separated by an adjacent groove by any suitable pitch. Typically, the pitch between two adjacent grooves is larger than the width of one or both of the adjacent grooves. The pitch can be constant or vary throughout the polishing pad. The pitch values described herein can be combined in any suitable manner so as to describe a polishing pad of the invention having two or more pitch values. For example, the pitch can be 10 μm or more, e.g., 50 μm or more, 100 μm or more, 150 μm or more 200 μm or more, 250 μm or more, 300 μm or more, 350 μm or more, 400 μm or more, 450 μm or more, 500 μm or more, 550 μm or more, 600 μm or more, 650 μm or more, 700 μm or more, 750 μm or more, 800 μm or more, 850 μm or more, 900 μm or more, 950 μm or more, 1000 μm or more, 1050 μm or more, 1100 μm or more, 1150 μm or more, 1200 μm or more, 1250 μm or more, 1300 μm or more, 1350 μm or more, 1400 μm or more, 1450 μm or more, 1500 μm or more, 1550 μm or more, 1600 μm or more, 1.650 μm or more, 1700 μm or more, 1750 μm or more, 1800 μm or more, 1850 μm or more, 1900 μm or more, 1950 μm or more, 2000 μm or more, 2100 μm or more, 2200 μm or more, 2300 μm or more, 2400 μm or more, 2500 μm or more, 2600 μm or more, 2700 μm or more, 2800 μm or more, 0.2900 μm or more, 3000 μm or more, 3100 μm or more 3200 μm or more 3300 μm or more 3400 μm or more, 3500 μm or more, 3600 μm or more, 3700 μm or more, 3800 μm or more, 3900 μm or more, 4000 μm or more, 4100 μm or more, 4200 μm or more, 4300 μm or more, 4400 μm or more, 4500 μm or more, 4600 μm or more, 4700 μm or more, 4800 μm or more, 4900 μm or more, 5000 μm or more, 5500 μm or more, 6000 μm or more, 6500 μm or more, 7000 μm or more, 7500 μm or more, 8000 μm or more, 8500 μm or more, 9000 μm or more, 9500 μm or more, or 10000 μm or more. Alternatively, or in addition, the pitch can be 10000 μm or less, 9500 μm or less, 9000 μm or less, 8500 μm or less, 8000 μm or less, 7500 μm or less, 7000 μm or less, 6500 μm or less, 6000 μm or less, 5500 μm or less, 5000 μm or less, 4900 μm or less, 4800 μm or less, 4700 μm or less, 4600 μm or less, 4500 μm or less, 4400 μm or less, 4300 μm or less, 4200 μm or less, 4100 μm or less, 4000 μm or less, 3900 μm or less, 3800 μm or less, 3700 μm or less, 3600 μm or less, 3500 μm or less, 3400 μm or less, 3300 μm or less, 3200 μm or less, 3100 μm or less, 3000 μm or less, 2900 μm or less, 2800 μm or less, 2700 μm or less, 2600 μm or less, 2500 μm or less, 2400 μm or less, 2300 μm or less, 2200 μm or less, 2100 μm or less, 2000 μm or less, 1950 μm or less, 1900 μm or less, 1850 μm or less, 1800 μm or less, 1750 μm or less, 1700 μm or less, 1650 μm or less, 0.1600 μm or less, 1550 μm or less, 1500 μm or less, 1450 μm or less, 1400 μm or less, 1350 μm or less, 1300 μm or less, 1250 μm or less, 1200 μm or less, 1150 μm or less, 1100 μm or less, 1050 μm or less, 1000 μm or less, 950 μm or less, 900 μm or less, 850 μm or less, 800 μm or less, 750 μm or less, 700 μm or less, 650 μm or less, 600 μm or less, 550 μm or less, 500 μm or less, 450 μm or less, 400 μm or less, 350 μm or less, 300 μm or less, 250 μm or less, 200 μm or less, 150 μm or less, 100 μm or less, 20 μm or less, or 10 μm or less. Thus, the pitch between adjacent grooves can be within the range bounded by any two of the foregoing endpoints. For example, the pitch can be 800 μm to 1200 μm, 600 μm to 1100 μm, or 2500 μm to 6000 μm. Preferably, the pitch between adjacent grooves is 2000 μm to 2100 μm.

In some embodiments of the invention, at least a portion of in area surrounding one or more of the centers of concentricity does not comprise any grooves, and the area typically has a radius greater than the pitch of the grooves immediately surrounding the area. In the context of a polishing pad having at least two centers of concentricity (i.e., a first center of concentricity and a second center of concentricity), at least a portion of an area surrounding the first center of concentricity, the second center of concentricity, or both, does not comprise any grooves, wherein the area has a radius greater than at least one of the first pitch (i.e., the pitch of the first plurality of concentric grooves) or the second pitch (i.e., the pitch of the second plurality of concentric grooves). In other embodiments, the polishing pad of the invention does not contain an area surrounding any centers of concentricity, wherein the area is defined as not comprising grooves and having a radius greater than the pitch of the grooves surrounding the area.

The descriptions hereinbelow of FIGS. 1-4 in relation to an area surrounding a center of concentricity are merely for illustrative purposes to better understand this feature. However, these, descriptions of FIGS. 1-4 in this manner should not be construed as purporting that the dimensions and proportions represented in FIGS. 1-4 are represenative of die dimensions and proportions of the polishing pad of the invention.

With reference to FIG. 1, at least a portion of an area surrounding the first center of concentricity 106 and the second center of concentricity 107 does not comprise any grooves, and the area has a radius greater than the pitch (i.e., first pitch) of the first plurality of concentric grooves 104 and the pitch (i.e., second pitch) of the second plurality of concentric groove 105.

With reference to FIG. 2, at least a portion of an area surrounding the first center of concentricity 206 and the second center of concentricity 207 does not comprise any grooves, and the area has a radius greater than the pitch (i.e., first pitch) of the first plurality of concentric grooves 204 and the pitch (i.e., second pitch) of the second plurality of concentric groove 205.

With reference to FIG. 3, at least a portion of an area surrounding the first center of concentricity 306 and the second center of concentricity 307 does not comprise any grooves, and the area has a radius greater than the pitch (i.e., first pitch) of the first plurality of concentric grooves 304 and the pitch (i.e., second pitch) of the second plurality of concentric groove 305.

The polishing pad of FIG. 4 does not contain an area surrounding any centers of concentricity, wherein the area is defined as not comprising grooves and having a radius greater than the pitch of the grooves surrounding, the area.

In some embodiments of the invention, at least a portion of the grooves in the plurality of grooves does not cross (i.e., intersect with) any other grooves in the plurality of grooves, in a preferred embodiment, none of the grooves in the plurality of grooves cross (i.e., intersect with) any other grooves in the plurality of grooves.

The polishing surface of the polishing, pad of the invention can be virtually divided into different regions, in which each region contains a plurality of grooves concentric about a center of concentricity. Each region typically consists of one plurality of grooves concentric about a center of concentricity, and the region typically does not contain any other grooves that are not concentric about the center of concentricity. The region typically does not contain any grooves that cross any other grooves. Each region typically contains grooves, but each region does not need to, but may, contain the center of concentricity about which the grooves in the region are concentric. In this regard, a region may contain grooves and the center of concentricity about which the grooves are concentric, or the region may not contain the center of concentricity about which the grooves are concentric. In the latter situation, the center of concentricity may be located in an adjacent region, at the interface between abutting, regions, or outside the confines of the polishing pad.

In the context of a polishing pad of the invention having at least two centers of concentricity (and associated concentric grooves), one or more of the following conditions typically are satisfied: (a) the first plurality of concentric grooves does not cross the second plurality of concentric grooves, and (b) the polishing pad has a first region containing the first plurality of concentric grooves and a second region containing the second plurality of concentric grooves, wherein the first region is adjacent to the second region. Of course, the polishing pad of the invention can contain more than two regions, for example, three, four, five, six, seven, eight, nine, or ten regions. Moreover, one or more of the following conditions typically also are satisfied: (a) the first center of concentricity is located in the first region and the second center of concentricity is located in the second region, (b) the first center of concentricity is located in the second region and the second center of concentricity is located in the first region, (c) both the first and second centers of concentricity are located in the first region, (d) the first center of concentricity is located at the interface and the second center of concentricity is located in either the first or second region, and (e) both the first and second centers of concentricity are located at the interface.

Figure 8:
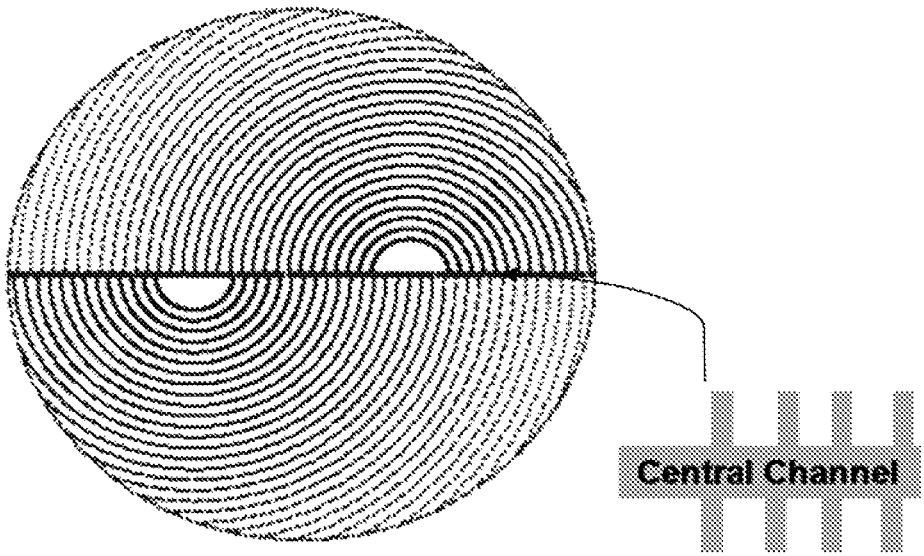
FIG. 8 illustrates a polishing pad according to an embodiment of the invention, wherein the pad contains a central channel.

In the polishing pad of the invention, the regions can be arranged in any suitable manner. For example, the regions can be adjacent to one another, or the regions can be separated from one another on the polishing surface of the polishing pad. Moreover, at least a portion of the regions can abut one another at an interface, the regions can entirely abut one another at an interface, or the regions may not abut one another at an interface but rather the regions may be separated from one another by one or more other regions. The one or more other regions can be termed a third, fourth, fifth, sixth, seventh, eighth, ninth, or tenth region, depending on the total number of regions present on the polishing surface. The one or more other regions may contain grooves, or the one or more other regions may be free of grooves (i.e., the one or other regions may not contain grooves). When the one or more other regions contain grooves, one or more of the other regions can comprise one groove or a plurality of grooves, or one or more of the other regions can consist of a single groove. In the situation where one or more of the other regions consists of a single groove, the single groove typically serves to separate the regions on the polishing pad, and the pluralities of grooves contained in the regions typically open into (i.e., empty into) the single groove. The plurality of grooves in one region that can open into (i.e., empty into) the single groove can have any suitable alignment with the plurality of grooves in another region that is abutting the single groove from the other side of the single groove, as discussed in more detail hereinbelow. This single groove can span from one edge of the polishing pad to the opposite edge of the polishing pad, and the single groove can be continuous or discontinuous, as defined hereinbelow. The single groove can have any suitable width and any suitable depth. The width and depth of the singe groove can be the same as or different from the width and depth of each groove in the pluralities of grooves. The width and depth values for each groove in the pluralities of grooves set forth herein is equally applicable to the single groove. For illustration purposes, features 110, 210, 310, and 410 in FIGS. 1-4, respectively, which are defined elsewhere herein as the interface between abutting regions, may instead be defined to represent a single groove, wherein the plurality of grooves in the adjacent regions open into i.e., empty into) this single groove. For purposes of description of this embodiment, when the features 110, 210, 310, and 410 in FIGS. 1-4 of the polishing pad are defined to represent a single groove, and this single groove spans from one edge of the polishing pad to the opposite edge of the polishing pad, and at least some of the plurality of grooves from the regions separated by the single groove empty into the single groove (i.e. are in fluid communication with die single groove), this single groove is referred to as a central channel. An example of a polishing, pad with die central channel is illustrated in FIG. 8.

The central channel may have any suitable depth. Preferably, the depth of the central channel is greater than the depth of the plurality of grooves. The depth is expressed as a distance measured from the polishing surface to the bottom of the channel. For example, the depth of the channel can be 20 μm or more, e.g., 50 μm or more, 100 μm or more, 150 μm or more, 200 μm or more, 250 μm or more, 300 μm or more, 350 μm or more, 400 μm or more, 450 μm or more, 500 μm or more, 550 μm or more, 600 μm or more, 650 μm or more, 700 μm or more, 750 μm or more, 800 μm or more, 850 μm or more, 900 μm or more, 950 μm or more, 1000 μm or more, 1050 μm or more, 1100 μm or more, ii 50 μm or more, 1200 μm or more, 1250 μm or more, 1300 μm or more, 1350 μm or more, 1400 μm or more, 1450 μm or more, 1500 μm or more, 1550 μm or more, 1600 μm or more, 1.650 μm or more, 1700 μm or more, 1750 μm or more, 1800 μm or more, 1850 μm or more, 1900 μm or more, 1950 μm or more, 2000 μm or more, 2100 μm or more, 2200 μm or more, 2300 μm or more, 2400 μm or more, 2500 μm or more, 2600 μm or more, 2700 μm or more, 2800 μm or more, 2900 μm or more, 3000 μm or more, 3100 μm or more, 3200 μm or more, 3300 μm or more, 3400 μm or more, 3500 μm or more, 3600 μm or more, 3700 μm or more, 3800 μm or more, 3900 μm or more, 4000 μm or more, 4100 μm or more, 4200 μm or more, 4300 μm or more, 4400 μm or more, 4500 μm or more, 4600 μm or more, 4700 μm or more, 4800 μm or more, 4900 μm or more, or 5000 μm or more. Alternatively, or in addition, the depth of the central channel ne 5000 μm or less, e.g., 4900 μm or less, 4800 μm or less, 4700 μm or less, 4600 μm or less, 4500 μm or less, 4400 μm or less, 4300 μm or less, 4200 μm or less, 4100 μm or less, 4000 μm or less, 3900 μm or less, 3800 μm or less, 3700 μm or less, 3600 μm or less, 3500 μm or less, 3400 μm or less, 3300 μm or less, 3200 μm or less, 3100 μm or less, 3000 μm or less, 2900 μm or less, 2800 μm or less, 2700 μm or less, 2600 μm or less, 2500 μm or less, 2400 μm or less, 2300 μm or less, 2200 μm or less, 2100 μm or less, 2000 μm or less, 1950 μm or less, 1900 μm or less, 1850 μm or less, 1800 μm or less, 1750 μm or less, 1700 μm or less, 1650 μm or less, 1600 μm or less, 1550 μm or less, 1500 μm or less, 1450 μm or less, 1400 μm or less, 1350 μm or less, 1300 μm or less, 1250 μm or less, 1200 μm or less, 1150 μm or less, 1100 μm or less, 1050 μm or less, 1000 μm or less, 950 μm or less, 900 μm or less, 850 μm or less, 800 μm or less, 750 μm or less, 700 μm or less, 650 μm or less, 600 μm or less, 550 μm or less, 500 μm or less, 450 μm or less, 400 μm or less, 350 μm or less, 300 μm or less, 250 μm or less, 200 μm or less, 150 μm or less, 100 μm. Thus, the depth of the central channel can be within the range bounded by any two of the foregoing endpoints. For example, the depth can be 20 μm to 800 μm, 2500 μm to 4800 μm, or 1050 μm to 1250 μm. Preferably, the depth of the central channel is greater than the depth of the plurality of concentric grooves, which abut and empty into, or are in fluid communication with, the central channel.

The central channel can have any suitable width. For example, the width of the central channel can be 10 μm or more, e.g., 50 μm or more, 100 μm or more, 150 μm or more, 200 μm or more, 250 μm or more, 300 μm or more, 350 μm or more, 400 μm or more, 450 μm or more, 500 μm or more, 550 μm or more, 600 μm or more, 650 μm or more, 700 μm or more, 750 μm or more, 800 μm or more, 850 μm or more, 900 μm or more, 950 μm or more, 1000 μm or more, 1.050 μm or more, 1100 μm or more, 1150 μm or more, 1200 μm or more, 1250 μm or more, 1300 μm or more, 1350 μm or more 1400 μm or more, 1450 μm or more, 1500 μm or more, 1550 μm or more, 1600 μm or more, 1650 μm or more, 1700 μm or more, 1750 μm or more, 1800 μm or more, 1850 μm or more, 1900 μm or more, 1950 μm or more, 2.000 μm or more, 2100 μm or more, 2200 μm or more, 2300 μm or more, 2400 μm or more, 2500 μm or more, 2600 μm or more, 2700 μm or more, 2800 μm or more, 2900 μm or more, 3000 μm or more, 3100 μm or more, 3200 μm or more, 3300 μm or more, 3400 μm or more, 3500 μm or more, 3600 μm or more, 3700 μm or more, 3800 μm or more, 3900 μm or more, 4000 μm or more, 4100 μm or more, 4200 μm or more, 4300 μm or more, 4400 μm or more, 4500 μm or more, 4600 μm or more, 4700 μm or more, 4800 μm or more, 4900 μm or more, or 5000 μm or more. Alternatively, or in addition, the width of the central channel be 5000 μm or less, e.g., 4900 μm or less, 4800 μm or less, 4700 μm or less, 4600 μm or less, 4500 μm or less, 4400 μm or less, 4300 μm or less, 4200 μm or less, 4100 μm or less, 4000 μm or less, 3900 μm or less, 3800 μm or less, 3700 μm or less, 3600 μm or less, 3500 μm or less, 3400 μm or less, 3300 μm or less, 3200 μm or less, 3100 μm or less, 3000 μm or less, 2900 μm or less, 2800 μm or less, 2700 μm or less, 2.600 μm or less, 2500 μm or less, 2400 μm or less, 2300 μm or less, 2200 μm or less, 2100 μm or less, 2000 μm or less, 1950 μm or less, 1900 μm or less, 1850 μm or less, 1800 μm or less, 1750 μm or less, 1700 μm or less, 1650 μm or less, 1600 μm or less, 11.550 μm or less, 1500 μm or less, 1450 μm or less, 1400 μm or less, 1350 μm or less, 1300 μm or less, 1250 μm or less, 1200 μm or less, 1150 μm or less, 1100 μm or less, 1050 μm or less, 1000 pin or less, 950 μm or less, 900 μm or less, 850 μm or less, 800 μm or less, 750 μm or less, 700 μm or less, 650 μm or less, 600 μm or less, 550 μm or less, 500 μm or less, 450 μm or less, 400 μm or less, 350 μm or less, 300 μm or less, 2.50 μm or less, 200 μm or less, 150 μm or less, 100 μm or less, 20 μm or less, or 10 μm or less. Thus, the width of the central channel can be within the range bounded by any two of the foregoing endpoints. For example, the width can be 200 μm to 800 μm, 1700 μm to 4800 μm, or 650 μm to 850 μm.

The central channel may have a rounding edge configuration. The rounding edge may be of any suitable dimensions. For example, the round mg edge can be defined by the depth of the rounded edge being greater than one half of the depth of the central channel. The depth of the rounded edge is understood to mean the depth starting from the surface of the polishing pad to the point where the wall of the central channel transitions from a rounded configuration to a straight configuration. The rounding edge may be alternatively described as the point along the channel wall where the channel width starts to increase relative to the width at the bottom of the channel. In other words, a channel without a rounding edge would have a uniform width measured from along the sides of the channel, from the bottom of the channel to the top of the channel, ending at the polishing surface. A central channel having a rounding edge would have a channel width (Why measured at the bottom of the channel and a channel width measured at the top of the channel (Wt) defined by the polishing surface, wherein Wb<Wt. For example, a channel with a rounding edge may have a channel width at the bottom of the channel equal to 80 mil, a channel width at a point representing half-way between the bottom and the top of the channel depth of 80 mil, and a channel width at the top of the channel of 100 mil.

In the context of a polishing pad of the invention having, at least two centers of concentricity with a first plurality of concentric grooves in a first region and a second plurality of concentric grooves in a second region, such a polishing pad typically can be characterized by one or more of the following conditions: (a) at least a portion of the first region abuts at least a portion of the second region at an interface, (b) the first region entirely abuts the second region at an interface, (c) the first region is entirely separated from the second region by a third region, and (d) at least a portion of the first region and at least a portion of the second region abut a common central channel. In a preferred embodiment, the first region entirely abuts the second region at an interface, and there is no intervening region located between the first region and the second region.

The polishing pad of the invention can have any suitable alignment of grooves (a) at an interface between abutting regions, and/or (h) across an intervening region. For example, (a) when one region entirely abuts or partially abuts an adjacent region at an interface, or (b) when one region is separated from an adjacent region by an intervening region, at least a portion of the grooves from one region may be aligned with and/or overlapping with at least a portion of the grooves of the adjacent region (a) at the interface and/or (b) across the intervening region, the grooves from one region may be entirely aligned with and/or overlapping with the grooves from the adjacent region (a) at the interface and/or (b) across the intervening region, or none of the grooves from one region limy be aligned with and/or overlapping with the grooves from the adjacent region (a) at the interface and/or (h) across the intervening region. As defined herein, "aligned" means that the center of a groove from one region is lined up with (i.e., aligned with) the center of a groove from an adjacent region. As defined herein, "overlapping" means that the center of a groove from one region is not aligned with the center of a groove from an adjacent region; however, the opening of the groove from one region overlaps with the opening of the groove from the adjacent region. When at least a portion of the grooves from one region are aligned with and/or overlapping with grooves from another region, 10% or more, e.g., 20% or more, 30% or more, 40% or more, 50% or more, 60% or more, 70% or more, 80% or more, 90% or more, or 100% of the grooves are aligned and/or overlapping, measured as a proportion of the number of grooves in alignment and/or in overlap relative to the total number of grooves (a) at the interface and/or (b) across the intervening region.

In the situation where a polishing pad has at least two abutting regions, i.e., a first region containing a first plurality of concentric grooves and a second region containing, a second plurality of concentric grooves wherein at least a portion of the two regions abut at an interface, typically one or more of the following conditions is satisfied: (a) at least one of the grooves in the first plurality of concentric grooves is aligned with at least one of the grooves in the second plurality of concentric grooves at the interface, (b) the grooves in the first plurality of concentric grooves are aligned with the grooves in the second plurality of concentric grooves at the interface, and (c) none of the grooves in the first plurality of concentric grooves is aligned with the grooves in the second plurality of concentric grooves at the interface.

Each groove in the plurality of grooves can be continuous or discontinuous. As used herein, a "continuous" groove is a groove having a depth that does not equal zero μm along the entire length of the groove within its region (e.g., first or second region). In other words, a continuous groove has a positive depth along its entire length within its region. As used herein, a "discontinuous" groove is a groove that has at least a portion along its length in which the depth of the groove equals zero within its region (e.g., first or second region). In other words, a discontinuous groove has a portion that becomes flush with the polishing surface at some point along its length within its region, such that the groove cannot be considered to be a groove at that point. The point at which the groove meets an adjacent region or the edge of the polishing pad is not considered to be a "discontinuity" for the purpose of categorizing a groove as "continuous" or "discontinuous," In other words, if a groove otherwise meets the definition of "continuous" as used herein but the groove ends at the edge of its region or the edge of the polishing pad, then such a groove would be considered to be a continuous groove. The grooves in a polishing pad of the invention can be continuous, discontinuous, or a combination thereof. In some embodiments, all of the grooves can be continuous, or all of the grooves can be discontinuous. In other embodiments, at least 10%, at least 20 at least 30%, at least 40 at least 50 at least 60%, at least 70%, at least 80 at least 90%, or 100% of the grooves are continuous discontinuous), measured as a proportion of the number of grooves in the polishing pad that are continuous (or discontinuous) relative to the total number of grooves in the polishing pad. In this regard, the number of grooves is summed as follows: the number of grooves in a region having a substantially different radius is summed, and then the number of grooves from each region in a polishing pad is summed, thereby obtaining a total overall number of grooves. The proportion of continuous or discontinuous grooves can then be calculated.

With reference to FIG. 1, the first plurality of concentric grooves 194 does not cross the second plurality of concentric grooves 105, and the polishing, pad has a first region 108 containing the first plurality of concentric grooves 104 and a second region 199 containing the second plurality of concentric grooves 105, wherein the first region 108 is adjacent to the second region 109. The first region 108 abuts the second region 109 at interface 110. None of the grooves in the first plurality of concentric grooves 104 is aligned with the grooves in the second plurality of concentric grooves 105 at interface 110. Both the first center of concentricity 106 and the second center of concentricity 107 are located at the interface 110 between abutting, regions 108 and 109. All of the grooves in FIG. 1 are continuous.

With reference to FIG. 2, the first plurality of concentric grooves 204 does not cross the second plurality of concentric grooves 205, and the polishing, pad has as first region 208 containing the first plurality of concentric grooves 204 and a second region 209 containing the second plurality of concentric grooves 205, wherein the first region 208 is adjacent to the second region 209. The first region 208 abuts the second region 209 at interface 210. None of the grooves in the first plurality of concentric grooves 204 is aligned with the grooves in the second plurality of concentric grooves 205 at interface 210. Both the first center of concentricity 206 and the second center of concentricity 207 are located at the interface 210 between abutting regions 208 and 209. All of the grooves in FIG. 2 are continuous.

With reference to FIG. 3, the first plurality of concentric grooves 304 does not cross the second plurality of concentric grooves 305, and the polishing pad has a first region 308 containing the first plurality of concentric grooves 304 and a second region 309 containing the second plurality of concentric grooves 305, wherein the first region 308 is adjacent to the second region 309. The first region 308 abuts the second region 309 at interface 310. The grooves in the first plurality of concentric grooves 304 are aligned with the grooves in the second plurality of concentric grooves 305 at the interface 310. The first center of concentricity 306 is located in the first region 308 and the second center of concentricity 307 is located in the second region 309. All of the grooves in FIG. 3 are continuous.

With reference to FIG. 4, the first plurality of concentric grooves 404 does not cross the second plurality of concentric grooves 405, and the polishing pad has a first region 498 containing the first plurality of concentric grooves 404 and a second region 409 containing the second plurality of concentric grooves 405, wherein the first region 408 is adjacent to the second region 409. The first region 408 abuts the second region 409 at interface 410. The grooves in the first plurality of concentric grooves 404 are aligned with the grooves in the second plurality of concentric grooves 495 at the interface 410. The first center of concentricity 406 is located in the second region 409 and the second center of concentricity 407 is located in the first region 408. All of the grooves in FIG. 4 are continuous.

Each groove in the plurality of grooves can have, any suitable proportional arc length. The proportional arc length of a groove is defined herein as a proportion of the actual arc length of a groove relative to the total arc length of the groove if the groove completed a closed arc about its center of concentricity. The actual arc length includes the length from one end of the groove to the other end of the groove, including any discontinuities that may be present (when the groove happens to be a discontinuous groove). The total arc length also includes any discontinuities in the groove that may be present (when the groove happens to be a discontinuous groove). The actual arc length and total arc length can be most readily calculated for each groove having a substantially constant radius (e.g. circular grooves); however, the actual and total arc length of a groove that does not have a substantially constant radius (e.g., oval-shaped groove) may still be readily calculated, as will be recognized by one of ordinary skill in the art. A groove that completes a closed arc around a center of concentricity has a proportional arc length of 100%. The proportional arc length can be 10% or more. e.g., 15% or more, 20% or more, 25% or more, 30% or more, 35% or more, 40% or more, 45% or more, 50% or more, 55% or more, 60% or more, 65% or more, 70% or more, 75% or more, 80% or more, 85% or more, 90% or more, or 95% or more. Alternatively, or in addition, the proportional arc length can be 95% or less, e, 90% or less, 85% or less, 80% or less, 75% or less, 70% or less, 65% or less, 60% or less, 55% or less, 50% or less, 45% or less, 40% or less, 35% or less, 30% or less, 25% or less, 20% or less, or 15% or less. Thus, the proportional arc length of a groove can be within the range bounded by any two of the foregoing endpoints. For example, the proportional arc length can be 25% to 85%, 35% to 50%, or 30% to 95%. Preferably, the proportional arc length is 30% or more.

Typically, a majority of the grooves in the plurality of grooves has the proportional arc length as defined herein. For example, 50% or more, e.g., 55% or more, 60% or more, 65% or more, 70% or more, 75% or more, 80% or more, 85% or more, 90% or more, 95% or more, or 100% of the grooves in the plurality of grooves has the proportional arc length as defined herein. The number of grooves having the proportional arc length as defined herein is calculated by summing the number of grooves having a substantially different radius in a region, and then summing the number of grooves from each region in a polishing pad, thereby obtaining a total overall number of grooves. The proportion of grooves having the proportional arc length as defined herein can then be calculated. Preferably, 80% or more of the grooves in the plurality of grooves has a proportional arc length of 30% or more.

Each groove in the plurality of grooves can have any suitable central angle. The central angle of a groove is defined herein as the angle formed between the two ends of a groove (that terminate at the edges of the region containing the groove or the edge of the polishing pad) and the center of concentricity about which the groove is concentric, in which the center of concentricity is at the vertex of the angle. The central angle is measured with respect to the side of the center of concentricity that faces the groove at issue (see, e.g., the description of FIG. 3 hereinbelow to understand this concept). Grooves that complete a closed arc around a center of concentricity have a central angle of 360°. For example, the central angle is 10° or more, e.g., 20° or more, 30° or more 40° or more, 50° or more 60° or more, 70° or more, 80° or more, 90° or more, 100° or more, 110° or more, 120° or more, 130° or more, 140° or more, 150° or more, 160° or more, 170° or more, 180° or more, 190° or more, 200° or more, 210° or more, 220° or more, 230° or more, 240° or more, 250° or more, 260° or more, 270° or more, 280° or more, 290° or more, 300° or more, 310° or more, 320° or more, 330° or more, 340° or more, 350° or more, or 360°. Alternatively, or in addition, the central angle is 360° or less, e.g., 350° or less, 340° or less, 330° or less, 320° or less, 310° or less, 300° or less, 290° or less, 280° or less, 270° or less, 260° or less, 250° or less, 240° or less, 230° or less, 220° or less, 210° or less, 200° or less, 190° or less, 180° or less, 170° or less, 160° or less, 150° or less, 140° or less, 130° or less, 120° or less, 110° or less, 100° or less, 90° or less, 80° or less, 70° or less, 60° or less, 50° or less, 40° or less, 30° or less, or 20° or less. Thus, the central angle can be within the range bounded by any two of the foregoing endpoints. For example, the central angle can be 90° to 300°, 70° to 180°, or 170° to 210°. In a preferred embodiment, the central angle is 170° to 190° (e, 180°).

Typically, a majority of the grooves in the plurality of grooves has the central angle as defined herein. For example, 50% or more, e.g., 55% or more, 60% or more, 65% or more, 70% or more, 75% or more, 80% or more, 85% or more, 90%, or more, 95% or more, or 100% of the grooves in the plurality of grooves has the central angle as defined herein. The number of grooves having the central angle as defined herein is calculated by summing the number of grooves having a substantially different radius in a region, and then summing the number of grooves from each region in a polishing pad, thereby obtaining a total overall number of grooves. The proportion of grooves having the central as defined herein can then be calculated. Preferably, 80% or more of the grooves in the plurality of grooves has a central angle of 180° or more.

The descriptions hereinbelow of FIGS. 1-4 in relation to the proportional arc length and central angle are merely for illustrative purposes to better understand the proportional arc length and central angle features. However, these descriptions of FIGS. 1-4 in this manner should not be construed as purporting that the dimensions and proportions represented in FIGS. 1-4 are representative of the dimensions and proportions of the polishing pad of the invention.

With reference to FIG. 1, the first groove in the first plurality of concentric grooves 104 that is concentric about, and most proximal to, the first center of concentricity 106 has a proportional arc length of 5% (actual arc length divided by total arc length if the groove completed a dosed arc about a center of concentricity). This first groove also has a central angle of 180°. The next ten grooves in the first plurality of concentric grooves 104 that are most proximal to the first center of concentricity 106 also have a proportional arc length of 50% and a central angle of 180°. The grooves in the second plurality of concentric grooves 105 can be characterized similarly. In this respect, a majority (e.g., 50% or more) of the grooves in the plurality of grooves in the polishing pad of FIG. 1 has a proportional arc length of 50% and a central angle of 180°.

With reference to FIG. 2, the first groove in the first plurality of concentric grooves 204 that is concentric about, and most proximal to, the first center of concentricity 206 has a proportional arc length of 50%. This first groove also has a central angle of 180°. The next ten grooves in the first plurality of concentric grooves 204 that are most proximal to the first center of concentricity 206 also have a proportional arc length of 50% and a central angle of 180°. The grooves in the second plurality of concentric grooves 205 can be characterized similarly. In this respect, a majority (e.g., 50% or more) of the grooves in the plurality of grooves in the polishing pad of FIG. 2 has a proportional arc length of 50% or more and a central angle of 180° or more.

With reference to FIG. 3, the first two grooves in the first plurality of concentric grooves 304 that are concentric, about, and most proximal to, the first center of concentricity 306 have a proportional arc length of 100% and a central angle of 360°. The next ten grooves in the first plurality of concentric grooves 304 that are most proximal to the first center of concentricity 306 have a proportional arc length of 75% or more and a central angle of 300° or more. The grooves in the second plurality of concentric grooves 305 can be characterized similarly. In this respect, a majority (e.g., or more) of the grooves in the plurality of grooves in the polishing pad of FIG. 3 has a proportional arc length of 75% or more and a central angle of 300° or more.

With reference to FIG. 4, a majority (e.g., 50% or more) of the grooves in the first plurality of concentric grooves 404 and second plurality of concentric grooves 405 has a proportional arc length of 30% or more and a central angle of 100° or more.

The centers of concentricity can be located in any suitable area of the polishing pad. One useful way to visualize the locations of the centers of concentricity is to note the locations with respect to a virtual x-axis and a virtual y-axis that are overlaid on the polishing surface, wherein the virtual x-axis and the virtual y-axis intersect at a right angle at the axis of symmetry of the polishing pad. Of course, the virtual x-axis and virtual y-axis can be overlaid on the polishing surface in any suitable manner and can intersect on the polishing surface at any suitable point, so as to facilitate an understanding of the locations of the polishing pad features, such as the locations of the centers of concentricity. For example, the virtual x-axis and virtual y-axis may intersect at a right angle at the axis of rotation, geometric, center, or any arbitrary point on the polishing surface. Moreover, the virtual x-axis and the virtual y-axis may intersect at a location on the polishing pad, wherein the location is defined as a proportion of the radius R of the polishing pad as measured from the axis of rotation of the polishing pad. In this respect, the location of intersection of the virtual x-axis and the virtual y-axis can be 0.05 R, 0.1 R, 0.15 R, 0.2 R, 0.25 R, 0.3 R, 0.35 R, 0.4 R, 0.45 R, 0.5 R, 0.55 R, 0.6 R, 0.65 R, 0.7 R, 0.75 R, 0.8 R, 0.85 R, 0.9 R, 0.95 R, or 1 R. The locations of the features of the polishing, pad can comprise any suitable combination of the following x and y coordinates in reference to a virtual x-axis and virtual y-axis: $x=0$, $x\geq 0$, $x\leq 0$, $y=0$, $y\geq 0$, and $y\leq 0$. Because the interface between two abutting regions is formed only as a result of the two regions abutting one another, the interface, as defined herein, is understood to be a part of both abutting regions. In this regard, when two regions abut at $y=0$, one region is located at $y\geq 0$ and the other region is located at $y\leq 0$. However, when a specific feature of the polishing pad, such as a center of concentricity, is being described, an attempt is made herein to distinguish between the location of the feature being in a given region or at an interface so as to clarify the location. Although the locations of the centers of concentricity in relation to a virtual x-axis and a virtual y-axis are described herein with respect to a polishing pad having two centers of concentricity e.g., a first center of concentricity and a second center of concentricity), this description is equally applicable to any number of centers of concentricity that may be present on the polishing, surface.

In some embodiments of the invention, when a virtual x-axis and a virtual y-axis are overlaid on the polishing surface in the plane of the polishing surface such that the x-axis and the y-axis intersect at a right angle at the axis of symmetry, the following conditions typically are satisfied: (a) the first center of concentricity is located at coordinates ($x>0$, $y\geq 0$), (b) the first region is located at $y\geq 0$, and (c) the second region is located at $y\leq 0$.

In other embodiments of the invention, when a virtual x-axis and a virtual y-axis are overlaid on the polishing surface in the plane of the polishing surface such that the x-axis and the y-axis intersect at a right angle at the axis of symmetry, the following conditions typically are satisfied: (a) the first center of concentricity is located at coordinates ($x<0$, $y\geq 0$), (b) the first region is located at $y\geq 0$, and (c) the second region is located at $y\leq 0$.

In some embodiments of the invention, when a virtual x-axis and a virtual y-axis are overlaid on the polishing surface in the plane of the polishing surface such that (i) the x-axis and the y-axis intersect at a right angle at the axis of symmetry, (ii) the first center of concentricity is located at coordinates ($x>0$, $y\geq 0$), and (iii) the first center of concentricity is located at the interface or in the first region, the following conditions are satisfied: (a) the first plurality of concentric grooves emanates from the first center of concentricity in a +y direction, (b) the second plurality of concentric grooves emanates from the second center of concentricity in a −y direction, and (c) when the plurality of grooves is extended infinitely in the plane of the polishing surface, the first plurality of concentric grooves is not symmetric with the second plurality of concentric, grooves by way of a mirror plane perpendicular to the polishing surface.

In other embodiments of the invention, when a virtual x-axis and a virtual y-axis are overlaid on the polishing surface in the plane of the polishing surface such that (i) the x-axis and the y-axis intersect at a right angle at the axis of symmetry, (ii) the first center of concentricity is located at the coordinates ($x<0$, $y\geq 0$), and (iii) the first center of concentricity is located at the interface or in the first region, the following conditions typically are satisfied: (a) the first plurality of concentric grooves emanates from the first center of concentricity in a +y direction, (b) the second plurality of concentric grooves emanates from the second center of concentricity in a −y direction, and (c) when the plurality of grooves is extended infinitely in the plane of the polishing surface, the first plurality of concentric grooves is not symmetric with the second plurality of concentric grooves by way of a minor plane perpendicular to the polishing surface.

The direction in which grooves emanate is determined by summing the combined length of all of the grooves at issue (e.g., all of the grooves in a given region), and determining the proportion of the combined length that emanates in a given direction. The direction that a groove emanates at a given point along the groove is determined by the direction of a line perpendicular to the tangent at the given point along, the groove. If a substantial portion e.g., at least 50%, at least 60%, at least 70%, at least 80%, at least 90%, or 100%) of the grooves at issue emanate in a given direction, then the grooves at issue are said to emanate in the given direction. When a groove completes an arc around the center of concentricity, the groove is not considered to emanate in any specific direction (i.e., the directions cancel out), and therefore this type of groove is not counted in determining the direction that a given set of grooves emanate. While, for simplicity, grooves are typically discussed herein as emanating in either (a) a +y direction or a −y direction, or (b) a +x direction or a −x direction, it is typically true that the grooves emanating in (a) a +y direction or a −y direction may also emanate in (b) a +x direction and/or a −x direction. In this regard, the grooves of the inventive polishing pad can be described as emanating in a direction that combines the descriptors +y, −y, +x, and/or −x, in any suitable combination, in order to describe the polishing pad of the invention.

With reference to FIG. 1, when a virtual x-axis and a virtual y-axis are overlaid on the polishing surface 100 in the plane of the polishing surface 100 such that the x-axis and the y-axis intersect at a right angle at the axis of symmetry 103, the following conditions are satisfied: (a) the first center of concentricity 106 is located at coordinates (x>0, y=0) at interface 110, (h) the second center of concentricity 107 is located at coordinates (x<0, y=0) at interface 110, (c) the first region 108 is located at y≥0, (d) the second region 109 is located at y≤0, (e) the first plurality of concentric grooves 104 emanate from the first center of concentricity 106 in a +y direction, (f) the second plurality of concentric grooves 105 emanate from the second center of concentricity 107 in a −y direction, and (g) when the plurality of grooves is extended infinitely in the plane of the polishing surface 100, the first plurality of concentric grooves 104 is not symmetric with the second plurality of concentric grooves 105 by way of a minor plane perpendicular to the polishing surface 100.

With reference to FIG. 2, when a virtual x-axis and a virtual y-axis are overlaid on the polishing surface 200 in the plane of the polishing surface 200 such that the x-axis and the y-axis intersect at a right angle at the axis of symmetry 203, the following conditions are satisfied: (a) the first center of concentricity 206 is located at coordinates (x<0, y=0) at interface 210, (b) the second center of concentricity 207 is located at coordinates (x>0, y=0) at interface 210, (c) the first region 208 is located at y≥0, (d) the second region 209 is located at y≤0, (e) the first plurality of concentric grooves 204 emanate from the first center of concentricity 206 in a +y direction, (f) the second plurality of concentric grooves 205 emanate from the second center of concentricity 207 in a −y direction, and (g) when the plurality of grooves is extended infinitely in the plane of the polishing surface 200, the first plurality of concentric grooves 204 is not symmetric with the second plurality of concentric grooves 205 by way of a mirror plane perpendicular to the polishing surface 200.

With reference to FIG. 3, when a virtual x-axis and a virtual y-axis are overlaid on the polishing surface 300 in the plane of the polishing surface 300 such that the x-axis and the y-axis intersect at a right angle at the axis of symmetry 303, the following conditions are satisfied: (a) the first center of concentricity 306 is located at coordinates (x>0, y=0), (b) the second center of concentricity 307 is located at coordinates (x<0, y=0), (c) the first region 308 is located at x≥0, (d) the second region 309 is located at x≤0, (e) the first plurality of concentric grooves 304 emanate from the first center of concentricity 306 in a +y direction, and (f) the second plurality of concentric grooves 305 emanate from the second center of concentricity 307 in a −y direction.

With reference to FIG. 4, when a virtual x-axis and a virtual y-axis are overlaid on the polishing surface 400 in the plane of the polishing surface 400 such that the x-axis and the y-axis intersect at a right angle at the axis of symmetry 403, the following conditions are satisfied: (a) the first center of concentricity 406 is located at coordinates (x<0, y=0), (b) the second center of concentricity 407 is located at coordinates (x>0, y=0), (c) the first region 408 is located at x≥0, (d) the second region 409 is located at x≤0, (e) the first plurality of concentric grooves 404 emanate from the first center of concentricity 406 in a +y direction, and (f) the second plurality of concentric grooves 405 emanate from the second center of concentricity 407 in a −y direction.

The plurality of grooves does not comprise, consist essentially of, or consist of a continuous spiral groove. The type of continuous spiral grooving patterns not encompassed by the invention are described in U.S. Pat. No. 7,377,840 to Deopura et al., hereby incorporated by reference in its entirely.

The polishing surface does not comprise, consist essentially of, or consist of a mosaic groove pattern. The type of mosaic groove pattern not encompassed by the invention is described in U.S. Pat. No. 7,252,582 to Renteln, hereby incorporated by reference in its entirety.

The polishing pad of the invention can comprise, consist essentially of, or consist of any suitable material. The material can be any suitable polymer and/or polymer resin. For example, the polishing pad can comprise elastomers, polyurethanes, polyolefins, polycarbonates, polyvinylalcohols, nylons, elastomeric rubbers, styrenic polymers, polyaromatics, fluoropolymers, polyimides, cross-linked polyurethanes, cross-linked polyolefins, polyethers, polyesters, polyacrylates, elastomeric polyethylenes, polytetrafluoroethylenes, polyethyleneteraphthalates, polyaramides, polyarylenes, polystyrenes, polymethylmethacrylates, copolymers and block copolymers thereof, and mixtures and blends thereof. The polymer and/or polymer resin can be a thermoset or thermoplastic polymer and/or polymer resin. Polishing pads comprising thermoplastic polymers, such as thermoplastic polyurethanes, generally result in polished substrates having lower defects than a substrate polished with a polishing pad comprising a thermoset polymer. However, polishing pads comprised of thermoplastic polymers generally exhibit a lower polishing rate than comparable polishing pads comprised of thermoset polymers, which lower polishing rate can adversely affect the time and costs associated with the polishing process. Preferably the material comprises a thermoplastic polyurethane (e.g., EPIC D100 available from Cabot Microelectronics Corporation). Suitable polishing pad materials, and suitable properties of a polishing pad material, are described in U.S. Pat. No. 6,896,593 to Prasad, hereby incorporated herein by reference in its entirety.

The polishing pad of the invention can be produced by any suitable method known in the art. For example, the polishing pad can be formed by film or sheet extrusion, injection molding, blow molding, thermoforming, compression molding, co-extrusion molding, reaction injection molding, profile extrusion molding, rotational molding, gas injection molding, film insert molding, foaming, casting, compression, or any combination thereof. When the polishing pad is made of, for example, a thermoplastic material (e.g., a thermoplastic polyurethane), the thermoplastic material can be heated to a temperature at which it will flow and is then formed into a desired shape by, for example, casting or extrusion.

The plurality of grooves can be formed in the polishing pad of the invention in any suitable manner known in the art. For example, the plurality of grooves may be formed by molding, machine cutting, laser cutting, and combinations thereof. The grooves may be molded at the same time as the fabrication of a polishing pad, or the polishing pad may first be fabricated, and then either (a) a grooving pattern molded on the surface of the polishing pad so as to form the polishing surface, or (b) a grooving pattern formed in a separate layer by any suitable means, which separate layer is then affixed by any suitable means to the surface of the polishing pad to form the polishing surface. When the grooves are formed by machine cutting or laser cutting, the polishing pad is typically formed first, and then a cutting tool or laser tool, respectively, produces grooves of a desired shape in the polishing surface of the polishing pad. Suitable grooving techniques are described in, e.g., U.S. Pat. No. 7,234,224 to Naugler et al., hereby incorporated by reference in its entirety.

The polishing pad of the invention may contain a light-transmitting region through which light may pass in order to monitor the polishing progress by way of an in situ end-point detection (EPD) system, e.g., to determine when a desired degree of planarization has been attained. The light-transmitting region typically is in the form of an aperture or window that has translucency to light, which allows light that has passed through the light-transmitting region to be detected by the EPD system. Suitable light-transmitting regions that may be used with the polishing pad of the invention are described in U.S. Pat. No. 7,614,933 to Benvegnu et al., hereby incorporated by reference in its entirety. The plurality of grooves may or may not be provided on the surface of the light-transmitting region, depending on the manufacturing method and the desired properties of the polishing pad and/or light-transmitting region.

The polishing pad of the invention can comprise the plurality of grooves as described herein in combination with any suitable grooving pattern known in the art. For example, the inventive grooving pattern can be combined with one or multiple x-axis grooves, one or multiple y-axis grooves, grooves concentric about the axis of rotation, grooves that intersect at or near the axis of rotation of the polishing pad and exit at the edge of the polishing pad (so as to form a pizza-like groove pattern), and combinations thereof.

The invention also provides a method of chemical-mechanically polishing a substrate, which method comprises, consists essentially of, or consists of (a) contacting a substrate with a polishing pad of the invention as described herein and a chemical-mechanical polishing composition, (b) moving the polishing pad relative to the substrate with the chemical-mechanical polishing composition therebetween, and (c) abrading at least a portion of the substrate to polish the substrate.

The removal rate of the substrate (i.e., polishing rate) is higher when employing the polishing pad of the invention, as compared to when employing an otherwise identical polishing pad that does not contain the plurality of grooves, as described herein. In some situations, the removal rate employing the polishing pad of the invention is compared to a polishing pad having a concentric grooving pattern (in which the polishing pad contains a plurality of grooves concentric about an axis of symmetry that is coincident with the axis of rotation of the polishing pad), or a polishing pad having no grooving patterns whatsoever. Typically, the material of the comparative polishing pad is the same as the material comprising the inventive polishing pad. The higher removal rate can be represented as a relative removal rate that is calculated by dividing the removal rate when employing the polishing pad of the invention by the removal rate when employing an otherwise identical polishing pad that does not contain the plurality of grooves as described herein. For example, the relative removal rate when employing the polishing pad of the invention is 1.02 or more, e.g., 1.04 or more, 1.06 or more, 1.08 or more, 1.1 or more, 1.12 or more, 1.14 or more, 1.16 or more, 1.18 or more, 1.2 or more, 1.22 or more, 1.24 or more, 1.26 or more, 1.28 or more, 1.3 or more, 1.32 or more, 1.34 or more, 1.36 or more, 1.38 or more, 1.4 or more, 1.42 or more, 1.44 or more, 1.46 or more, 1.48 or more, 1.5 or more, 1.55 or more, 1.6 or more, 1.65 or more, 1.7 or more, 1.75 or more, 1.8 or more, 1.85 or more, 1.9 or more, 1.95 or more, 2 or more, 2.2 or more, 2.4 or more, 2.6 or more, 2.8 or more, 3 or more, 3.5 or more, 4 or more, 4.5 or more, or 5 or more. Alternatively, or in addition, the relative removal rate is 5 or less, e.g., 4.5 or less, 4 or less, 3.5 or less, 3 or less, 2.8 or less, 2.6 or less, 2.4 or less, 2.2 or less, 2 or less, 1.95 or less, 1.9 or less, 1.85 or less, 1.8 or less, 1.75 or less, 1.7 or less, 1.65 or less, 1.6 or less, 1.55 or less, 1.5 or less, 1.48 or less, 1.46 or less, 1.44 or less, 1.42 or less, 1.4 or less, 1.38 or less, 1.36 or less, 1.34 or less, 1.32 or less, 1.3 or less, 1.28 or less, 1.26 or less, 1.24 or less, 1.22 or less, 1.2 or less, 1.18 or less, 1.16 or less, 1.14 or less, 1.12 or less, 1.1 or less, 1.08 or less, 1.06 or less, 1.04 or less, or 1.02 or less. Thus, the relative removal rate can be within the range bounded by any two of the foregoing endpoints. For example, the relative removal rate can be 1.06 to 1.3, 1.75 to 2, or 3 to 5.

Any suitable flow rate of slurry can be employed in the method. A lower slurry flow rate will typically result in a lower polishing rate, and a higher slurry flow will typically result in a higher polishing rate. For example, the flow rate can be 50 mL/min or more, e.g., 60 mL/min or more, 70 mL/min or more, 80 mL/min or more, 90 mL/min or more, 100 mL/min or more, 110 mL/min or more, 120 mL/min or more, 130 mL/min or more, 140 mL/min or more, or 150 mL/min or more. Alternatively, or in addition, the slurry flow rate can be 160 mL/min or less, e.g., 150 mL/min or less, 140 mL/min or less, 130 mL/min or less, 120 mL/min or less, 110 mL/min or less, 100 m/min or less, 90 mL/min or less, 80 mL/min or less, 70 mL/min or less, or 60 mL/min or less. Thus, the slurry flow rate can be within the range bounded by any two of the foregoing endpoints. For example, the slurry flow rate can be 60 mL/min to 140 mL/min, 50 mL/min to 120 mL/min, or 100 mL/min to 110 mL/min. Preferably, the slurry flow rate is 90 mL/min to 120 mL/min. It was surprisingly found that, when employing a polishing pad of the invention in a polishing process, the polishing rate was minimally affected, or even increased, when the flow rate was decreased by 25% (see, e.g., the Example herein). Without wishing to be bound by any theory, it is believed that a polishing pad of the invention is able to retain the polishing slurry for a longer amount of time than conventionally grooved polishing pads, thereby resulting in a lower slurry flow requirement for a polishing pad of the invention in order to obtain a similar polishing rate.

Any suitable substrate or substrate material can be employed in the method. For example, the substrates include memory storage devices, semiconductor substrates, and glass substrates. Suitable substrates for use in the method include memory disks, rigid disks, magnetic heads, MEMS devices, semiconductor wafers, field emission displays, and other microelectronic substrates, especially substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals). Preferably the substrate comprises tungsten.

The method can utilize any suitable polishing composition. The polishing composition typically comprises an aqueous carrier, a pH adjustor, and optionally an abrasive. Depending on the type of workpiece being polished, the polishing composition optionally can further comprise oxidizing agents, organic or inorganic acids, complexing agents, pH buffers, surfactants, corrosion inhibitors, antifoaming agents, and the like. When the substrate is comprised of tungsten, a preferred polishing composition comprises colloidally stable fumed silica as an abrasive, hydrogen peroxide as an oxidizing agent, and water (e.g., the slurry SEMI-SPERSE W2000 available from Cabot Microelectronics Corporation).

The polishing pad of the invention can be rotated in the method in any suitable direction. For example, when viewing the polishing surface of the polishing pad from a direction perpendicular to the polishing surface, the polishing pad can be rotated in a clockwise direction or a counterclockwise direction. In the polishing pad of the invention, when the plurality of grooves is extended infinitely in the plane of the polishing surface, and the plurality of grooves are symmetric by way of a mirror plane perpendicular to the polishing surface, the polishing pad typically can be rotated in either the clockwise direction or the counterclockwise direction and similar or the same polishing results typically will be achieved (e.g., similar or same polishing rate, slurry distribution, waste removal, etc.). In other words, when the polishing pad contains such a mirror plane perpendicular to the polishing surface, the polishing pad typically can be rotated in any direction without any significant impact on polishing results. However, when the polishing pad does not contain such a mirror plane perpendicular to the polishing surface, the rotation direction typically has an effect on the polishing results.

In this regard, a polishing pad meeting the following criteria typically will be rotated in the method in a clockwise direction when viewing the polishing surface from a direction perpendicular to the polishing surface: a polishing pad of the invention wherein, when a virtual x-axis and a virtual y-axis are overlaid on the polishing surface in the plane of the polishing surface such that the x-axis and the y-axis intersect at a right angle at the axis of symmetry, the following conditions are satisfied: (a) a first center of concentricity is located at coordinates ($x>0$, $y\geq 0$), (b) the first region is located at $y\geq 0$, and (c) the second region is located at $y\leq 0$. In some embodiments, however, it may be preferable to rotate the polishing pad in a counterclockwise direction.

Additionally, a polishing pad meeting the following criteria typically also will be rotated in the method in a clockwise direction when viewing the polishing surface from a direction perpendicular to the polishing surface: a polishing pad of the invention wherein, when a virtual x-axis and a virtual y-axis are overlaid on the polishing surface in the plane of the polishing surface such that (i) the x-axis and the y-axis intersect at a right angle at the axis of symmetry, (ii) a first center of concentricity is located at coordinates ($x>0$, $y\geq 0$), and (iii) a first center of concentricity is located at the interface or in the first region, the following conditions are satisfied: (a) the first plurality of concentric grooves emanates from the first center of concentricity in a +y direction, (b) the second plurality of concentric grooves emanates from the second center of concentricity in a −y direction, and (c) when the plurality of grooves is extended infinitely in the plane of the polishing surface, the first plurality of concentric grooves is not symmetric with the second plurality of concentric grooves by way of a mirror plane perpendicular to the polishing surface. In some embodiments, however, it may be preferable to rotate the polishing pad in a counterclockwise direction.

Alternatively, a polishing pad meeting the following criteria typically will be rotated in the method in a counterclockwise direction when viewing the polishing surface from a direction perpendicular to the polishing surface: a polishing pad of the invention wherein, when a virtual x-axis and a virtual y-axis are overlaid on the polishing surface in the plane of the polishing surface such that the x-axis and the y-axis intersect at a right angle at the axis of symmetry, the following conditions are satisfied: (a) a first center of concentricity is located at coordinates ($x<0$, $y\geq 0$), (b) the first region is located at $y\geq 0$, and (c) the second region is located at $y\leq 0$. In some embodiments, however, it may be preferable to rotate the polishing pad in a clockwise direction.

Moreover, a polishing pad meeting the following criteria typically also will be rotated in the method in a counterclockwise direction when viewing the polishing surface from a direction perpendicular to the polishing surface: a polishing pad of the invention wherein, when a virtual x-axis and a virtual y-axis are overlaid on the polishing surface in the plane of the polishing surface such that (i) the x-axis and the y-axis intersect at a right angle at the axis of symmetry, (ii) a first center of concentricity is located at the coordinates ($x<0$, $y\geq 0$), and (iii) a first center of concentricity is located at the interface or in the first region, the following conditions are satisfied: (a) the first plurality of concentric grooves emanates from the first center of concentricity in a +y direction, (b) the second plurality of concentric grooves emanates from the second center of concentricity in a −y direction, and (c) when the plurality of grooves is extended infinitely in the plane of the polishing surface, the first plurality of concentric grooves is not symmetric with the second plurality of concentric grooves by way of a mirror plane perpendicular to the polishing surface. In some embodiments, however, it may be preferable to rotate the polishing pad in a clockwise direction.

The polishing pad depicted in FIG. 1 typically will be rotated in a clockwise direction when viewing the polishing surface from a direction perpendicular to the polishing surface. The polishing pad depicted in FIG. 2 typically will be rotated in a counterclockwise direction when viewing the polishing surface from a direction perpendicular to the polishing surface. The polishing pads depicted in FIGS. 3 and 4 typically can be rotated in either a clockwise direction or a counterclockwise direction.

Polishing pads having the features described herein result in a variety of advantageous effects when employed in a polishing process, as compared to the effects obtained when employing polishing pads comprising conventional grooving patterns. Conventional grooving patterns include, for example, concentric grooves (grooves concentric about an axis of symmetric that is coincident with the axis of rotation of the polishing pad), XY grooves (grooves consisting of one x-axis grooves and multiple y-axis grooves), and concentric-+XY (grooves consisting of the "concentric" grooves plus the "XY" grooves overlaid on the same polishing pad). The advantageous effects associated with employing a polishing pad of the invention in a polishing process include an increased polishing rate, a longer slurry retention time, improved slurry distribution on the polishing pad, and improved ability to remove waste material that is abraded during polishing. A polished substrate produced using the inventive polishing pad described herein has an excellent degree of planarity and low defects, making the inventive polishing pad suitable for use in CMP processes designed to produce polished substrates for a variety of applications.

The following example further illustrates the invention but, of course, should not be construed as in any way limiting its scope.

EXAMPLE

This example demonstrates the improved polishing rate obtained when using polishing pads of the invention in a polishing process, as compared to using a conventional polishing pad in the polishing process. This example also demonstrates that the polishing rate surprisingly stays about the same or increases when the slurry flow rate is decreased when using the polishing pads of the invention. Additionally, this example demonstrates that the rotation direction has an effect on the polishing rate when using certain polishing pads of the invention in a polishing process.

In this example, chemical-mechanical polishing was performed using a 200 mm Mirra polishing tool available from Applied Materials using the following process conditions: a membrane pressure of 29 kPa, an inner tube pressure of 45 kPa, a retaining ring pressure of 52 kPa, a platen speed of 113 rotations per minute (rpm), a head speed of 111 rpm, and a polishing time of 60 sec. The chemical-mechanical polishing slurry comprised colloidally stable fumed silica as an abrasive, hydrogen peroxide as an oxidizing agent, and water (e.g., the slurry SEMI-SPERSE W2000 available from Cabot Microelectronics Corporation). The substrate comprised a blanket layer of tungsten. The polishing pads were rotated in the polishing process in a clockwise direction when viewing the polishing surface of the polishing pad from a direction perpendicular to the polishing surface.

All of the polishing pads were comprised of a thermoplastic polyurethane (e.g., EPIC D100 available from Cabot Microelectronics Corporation), and all of the polishing pads contained a plurality of grooves. Each groove in the plurality of grooves had a depth of 760 microns (i.e., 30 mils), a width of 500 microns (i.e., 20 mils), and each groove was separated from an adjacent groove by a pitch of 2030 microns (i.e., 80 mils). The grooving patterns were formed in the polishing pads by a conventional machine cutting technique. The polishing pads in this example differed only with respect to the arrangement of the grooves on the polishing surface (i.e., the grooving pattern). The control polishing pad contained a plurality of grooves concentric about the axis of rotation of the control polishing pad. Polishing Pads 1-4 of the invention contained the grooving patterns depicted in FIGS. 1-4, respectively. FIGS. 1-4 are merely illustrative of the types of grooving patterns of polishing pads of the invention in this example so as to facilitate an understanding of the inventive grooving patterns; however, the dimensions and proportions represented in FIGS. 1-4 are not necessarily representative of the actual dimensions and proportions of a polishing pad of the invention.

The Control Polishing Pad and the Inventive Polishing Pads 1-4 were employed in the polishing process using a slurry flow rate of 120 mL/min and a slurry flow rate of 90 mL/min. The polishing process was performed eight times at each slurry flow rate using the Control Polishing Pad, and the eight polishing results for each slurry flow rate were averaged. The polishing process was performed three times for each Inventive Polishing Pad 1-4 at each slurry flow rate, and the three polishing results for each of Inventive Polishing Pads 1-4 at each slurry flow rate were averaged. The absolute and relative removal rates are reported in Table 1 and are also depicted graphically in FIG. 7.

TABLE 1

| | Slurry Flow Rate | | | |
|---|---|---|---|---|
| | 120 mL/min | 90 mL/min | 120 mL/min | 90 mL/min |
| | Removal Rate (Å/min) | | Relative Removal Rate | |
| Control Pad | 5238 | 5058 | 1.00 | 0.97 |
| Pad 1 | 6575 | 6765 | 1.26 | 1.29 |
| Pad 2 | 5605 | 5552 | 1.07 | 1.06 |
| Pad 3 | 5752 | 5987 | 1.10 | 1.14 |
| Pad 4 | 5546 | 5612 | 1.06 | 1.07 |

Figure 7:
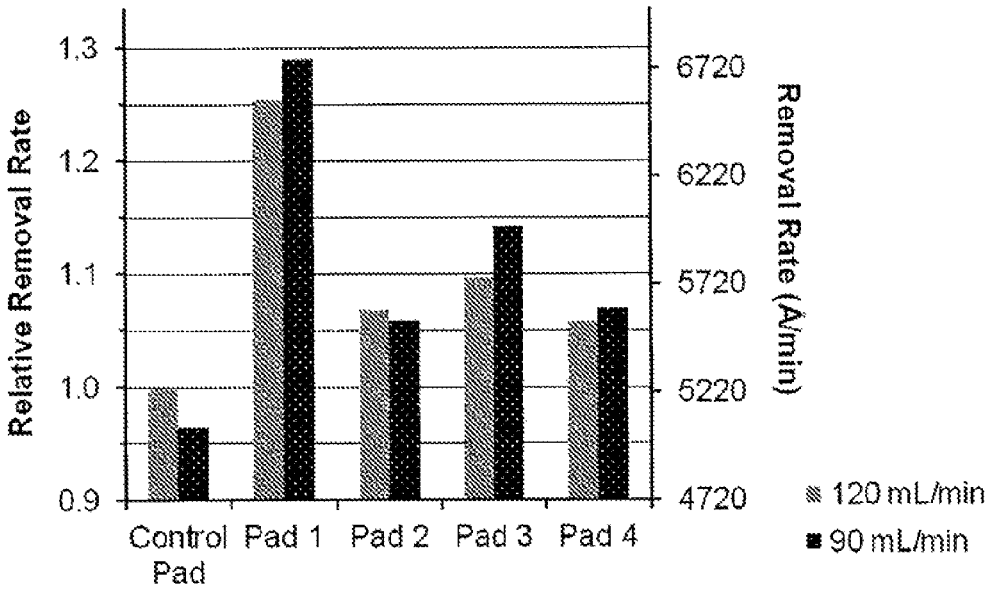
FIG. 7 is a bar graph comparing, at two different slurry flow rates, the removal rates of a control polishing pad comprising conventional concentric grooves centered at the axis of rotation of the polishing pad with four inventive polishing pads having the grooving, patterns depicted FIGS. 1-4.

As illustrated in Table 1 and FIG. 7, the removal rates were higher when Inventive Polishing Pads 1-4 were employed in the polishing process, as compared to the removal rates when the Control Polishing Pad was employed in the process. Moreover, when the Control Polishing Pad was used, the removal rate predictably decreased when the slurry flow rate was lowered from 120 mL/min to 90 mL/min. In contrast, when Inventive Polishing Pads 1-4 were employed, lowering the slurry flow rate from 120 mL/min to 90 mL min either had little effect on the removal rate (see Inventive Polishing Pads 2 and 4) or the removal rate surprisingly increased (see Inventive Polishing Pads 1 and 3), thereby suggesting that the slurry was retained on the polishing surface of Inventive Polishing Pads 1-4 for a longer amount of time than the Control Polishing Pad. Furthermore, the removal rate when using Inventive Polishing Pad 1 was significantly higher than when its mirror image (i.e., Inventive Polishing Pad 2) was employed, indicating that the rotation direction of the polishing pad can have a significant effect on the removal rate in the situation where the polishing pads do not have a mirror plane perpendicular to the polishing surface.

These results confirm that, as compared to a polishing pad comprising a conventional grooving pattern, polishing pads of the invention, inter alia, (a) exhibit a higher removal, (b) require less slurry as a result of, inter alia, longer slurry retention times, and (c) can exhibit different removal rates depending on rotation direction in the situation where the polishing pad does not contain a mirror plane perpendicular to the polishing surface of the polishing pad.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A polishing pad comprising an axis of rotation, a polishing surface, and a plurality of grooves set into the polishing surface, wherein the plurality grooves is composed of at least (a) a first plurality of concentric grooves having a first center of concentricity, and (b) a second plurality of concentric grooves having a second center of concentricity, wherein the polishing pad has either a first mirror plane located along a virtual y-axis, or a second mirror plane located along a virtual x-axis, and wherein (1) the first center of concentricity is not coincident with the second center of concentricity,
(2) the axis of rotation of the polishing pad is not coincident with at least one of the first center of concentricity and the second center of concentricity,
(3) the plurality of grooves does not consist of a continuous spiral groove, and
(4) the plurality of grooves does not comprise a mosaic groove pattern, and
(5) wherein the polishing pad further comprises a single central channel extending along a diameter of the polishing pad.

2. The polishing pad of claim 1, wherein, when the plurality of grooves is extended infinitely in the plane of the polishing surface, the first plurality of concentric grooves is symmetric with the second plurality of concentric grooves by way of a 180° rotation about an axis of symmetry perpendicular to the polishing surface.

3. The polishing pad of claim 1, wherein, when the plurality of grooves is extended infinitely in the plane of the polishing surface, the first plurality of concentric grooves is symmetric with the second plurality of concentric grooves by way of the first mirror plane that (a) is perpendicular to the polishing surface and (b) does not intersect with either the first center of concentricity or the second center of concentricity.

4. The polishing pad of claim 1, wherein, when the plurality of grooves is extended infinitely in the plane of the polishing surface, the first plurality of concentric grooves is symmetric with the second plurality of concentric grooves by way of the second mirror plane that (a) is perpendicular to the polishing surface and (b) intersects with both the first center of concentricity and the second center of concentricity.

5. The polishing pad of claim 1, wherein at least a portion of the grooves in the plurality of grooves is an arc having a shape selected from the group consisting of substantially circular, substantially semi-circular, substantially parabolic, substantially oval, and combinations thereof.

6. The polishing pad of claim 5, wherein the shape is substantially circular or substantially semi-circular, and each respective groove in the first plurality of concentric grooves has a substantially constant radius with respect to the first center of concentricity, and each respective groove in the second plurality of concentric grooves has a substantially constant radius with respect to the second center of concentricity.

7. The polishing pad of claim 1, wherein (a) the first plurality of concentric grooves does not cross the second plurality of concentric grooves, and (b) the polishing pad has a first region containing the first plurality of concentric grooves and a second region containing the second plurality of concentric grooves, wherein the first region is adjacent to the second region.

8. The polishing pad of claim 7, wherein one or more of the following conditions is satisfied:

(a) at least a portion of the first region abuts at least a portion of the second region at an interface,
(b) the first region abuts the second region at an interface,
(c) the first region is entirely separated from the second region by a third region, and
(d) the first region is entirely separated from the second region by a central channel.

9. The polishing pad of claim 8, wherein one or more of the following conditions is satisfied:

(a) at least one of the grooves in the first plurality of concentric grooves is aligned with at least one of the grooves in the second plurality of concentric grooves at the interface,
(b) the grooves in the first plurality of concentric grooves are aligned with the grooves in the second plurality of concentric grooves at the interface,
(c) none of the grooves in the first plurality of concentric grooves is aligned with the grooves in the second plurality of concentric grooves at the interface,
(d) the first center of concentricity is located in the first region and the second center of concentricity is located in the second region,
(e) the first center of concentricity is located in the second region and the second center of concentricity is located in the first region,
(f) both the first and second centers of concentricity are located in the first region, and
(g) the first center of concentricity is located at the interface and the second center of concentricity is located in either the first or second region, and
(h) both the first and second centers of concentricity are located at the interface.

10. The polishing pad of claim 7, wherein, when a virtual x-axis and a virtual y-axis are overlaid on the polishing surface in the plane of the polishing surface such that (i) the x-axis and the y-axis intersect at a right angle at the axis of symmetry, (ii) the first center of concentricity is located at the coordinates ($x < 0$, $y \geq 0$), and (iii) the first center of concentricity is located at the interface or in the first region, the following conditions are satisfied:

(a) the first plurality of concentric grooves emanates from the first center of concentricity in a +y direction, (b) the second plurality of concentric grooves emanates from the second center of concentricity in a −y direction, and (c) when the plurality of grooves is extended infinitely in the plane of the polishing surface, the first plurality of concentric grooves is not symmetric with the second plurality of concentric grooves by way of a mirror plane perpendicular to the polishing surface.

11. The polishing pad of claim 1, wherein the polishing pad comprises a thermoplastic polyurethane.

12. The polishing pad of claim 1, wherein one of the following conditions is satisfied:

(a) at least one groove in the first plurality of concentric grooves or second plurality of concentric grooves completes a closed arc around the first center of concentricity or the second center of concentricity, respectively, or (b) none of the grooves in the first plurality of concentric grooves or second plurality of concentric grooves completes a closed arc around the first center of concentricity or the second center of concentricity, respectively.

13. The polishing pad of claim 1, wherein the central channel has a rounding edge.

14. The polishing pad of claim 1, wherein (i) the polishing pad has a thickness T, (ii) each groove in the first plurality of concentric grooves has a first depth, a first width, and is separated from an adjacent groove by a first pitch, and (iii) each groove in the second plurality of concentric grooves has a second depth, a second width, and is separated from an adjacent groove by a second pitch, and wherein one or more of the following conditions is satisfied:

(a) the first depth and the second depth measured as a fraction of the thickness T of the polishing pad independently are 0.01 T to 0.99 T and can be the same or different, and the first depth, the second depth, or both, either is constant or varies within the first plurality of concentric grooves, the second plurality of concentric grooves, or both, (b) the first width and the second width independently are 0.005 cm to 0.5 cm and can be the same or different, and the first width, the second width, or both, either is constant or varies within the first plurality of concentric grooves, the second plurality of concentric grooves, or both, and (c) the first pitch and the second pitch independently are 0.005 cm to 1 cm and can be the same or different, and the first pitch, the second pitch, or both, either is constant or varies within the first plurality of concentric grooves, the second plurality of concentric grooves, or both.

15. The polishing pad of claim 14, wherein at least a portion of an area surrounding the first center of concentricity, the second center of concentricity, or both, does not comprise any grooves, wherein the area has a radius greater than at least one of the first pitch or the second pitch.

16. A method of chemical-mechanically polishing a substrate, which method comprises:

(a) contacting a substrate with a chemical-mechanical polishing composition and the polishing pad of claim 1, (b) moving the polishing pad relative to the substrate with the chemical-mechanical polishing composition therebetween, and (c) abrading at least a portion of the substrate to polish the substrate.

17. The method of claim 16, wherein a removal rate of the substrate is higher, as compared to an otherwise identical polishing pad that does not contain the plurality of grooves.

18. The method of claim 17, wherein the substrate is tungsten.

19. The method of claim 16, wherein the polishing pad comprises a thermoplastic polyurethane.

* * * * *